US009175598B2

(12) United States Patent
Geyer et al.

(10) Patent No.: US 9,175,598 B2
(45) Date of Patent: Nov. 3, 2015

(54) TWO-STROKE ENGINE, SAND CORE FOR PRODUCING A TWO-STROKE ENGINE, AND METHOD FOR OPERATING A TWO-STROKE ENGINE

(75) Inventors: Werner Geyer, Berglen (DE); Jörg Schlossarczyk, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 269 days.

(21) Appl. No.: 12/968,298

(22) Filed: Dec. 15, 2010

(65) Prior Publication Data

US 2011/0146642 A1 Jun. 23, 2011

(30) Foreign Application Priority Data

Dec. 19, 2009 (DE) ..... 10 2009 059 143

(51) Int. Cl.

| | |
|---|---|
| ***F02B 25/00*** | (2006.01) |
| ***F02B 33/04*** | (2006.01) |
| ***B22C 9/10*** | (2006.01) |
| ***F02B 25/02*** | (2006.01) |
| ***F02B 33/30*** | (2006.01) |
| ***F02F 1/00*** | (2006.01) |
| ***F02F 1/22*** | (2006.01) |
| *F02B 75/02* | (2006.01) |

(52) U.S. Cl.

CPC . *F02B 33/04* (2013.01); *B22C 9/10* (2013.01); *F02B 25/02* (2013.01); *F02B 33/30* (2013.01); *F02F 1/002* (2013.01); *F02F 1/22* (2013.01); *F02B 2075/025* (2013.01)

(58) Field of Classification Search

USPC ..... 123/73 PP, 73 R, 65 P, 65 R, 65 A, 65 E, 123/65 S, 65 VA, 50 B, 73 F, 73 FA, 73 AA

See application file for complete search history.

(56) References Cited

U.S. PATENT DOCUMENTS

| | | | | |
|---|---|---|---|---|
| 2,454,819 | A * | 11/1948 | Mayer | 164/366 |
| 6,293,235 | B1 | 9/2001 | Cobb, Jr. | |
| 6,718,917 | B2 | 4/2004 | Andersson et al. | |
| 6,880,503 | B2 * | 4/2005 | Rosskamp | 123/73 PP |
| 7,363,888 | B2 | 4/2008 | Klimmek et al. | |
| 7,415,949 | B2 | 8/2008 | Carlsson et al. | |
| 7,469,666 | B2 * | 12/2008 | Martinsson et al. | 123/73 PP |
| 2002/0179026 | A1 * | 12/2002 | Laimbock | 123/73 C |

FOREIGN PATENT DOCUMENTS

| | | |
|---|---|---|
| EP | 1 135 585 B1 | 7/2005 |
| JP | S35-032903 | 12/1960 |

(Continued)

*Primary Examiner* — Hung Q Nguyen
*Assistant Examiner* — Ruben Picon-Feliciano
(74) *Attorney, Agent, or Firm* — Gudrun E. Huckett

(57) ABSTRACT

A two-stroke engine has a cylinder with a combustion chamber and a reciprocating piston for driving a crankshaft. Transfer passages connect the crankcase in at least one position of the piston with the combustion chamber and open by piston-controlled transfer ports into the combustion chamber. An inlet opens into the crankcase and an outlet is provided at the combustion chamber. The engine is dividable into four sectors parallel to a longitudinal cylinder axis. The transfer port of a first transfer passage is arranged in the first sector, the outlet is arranged in the second sector, the transfer port of a second transfer passage is provided in the third sector, and the inlet is arranged in the fourth sector. Within the cylinder the first and second transfer passages, at a spacing from a separation plane between cylinder and crankcase, pass together into one of the second and fourth sectors.

18 Claims, 13 Drawing Sheets

(56) References Cited

FOREIGN PATENT DOCUMENTS

| | | | |
|---|---|---|---|
| JP | S47-023516 | | 4/1971 |
| JP | S54151713 | A | 11/1979 |
| JP | S58-079621 | | 5/1983 |
| JP | H11324683 | A | 11/1999 |
| JP | 2001193557 | A | 7/2001 |

* cited by examiner

Fig. 23
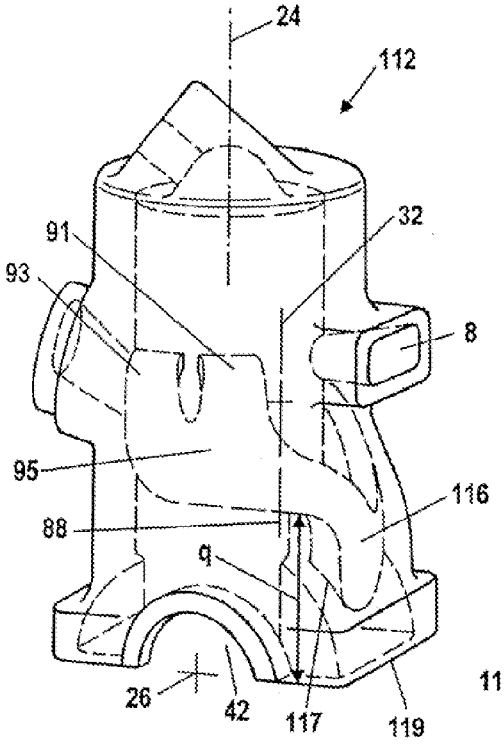
Fig. 24
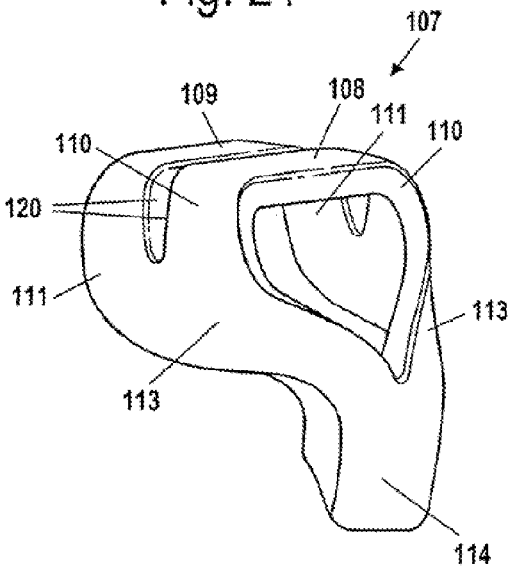
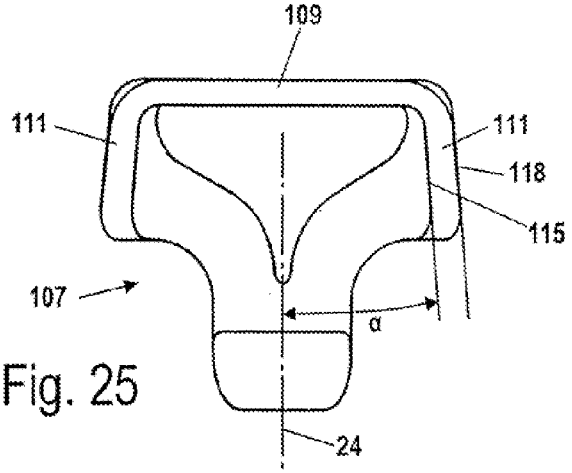
Fig. 25
Fig. 26
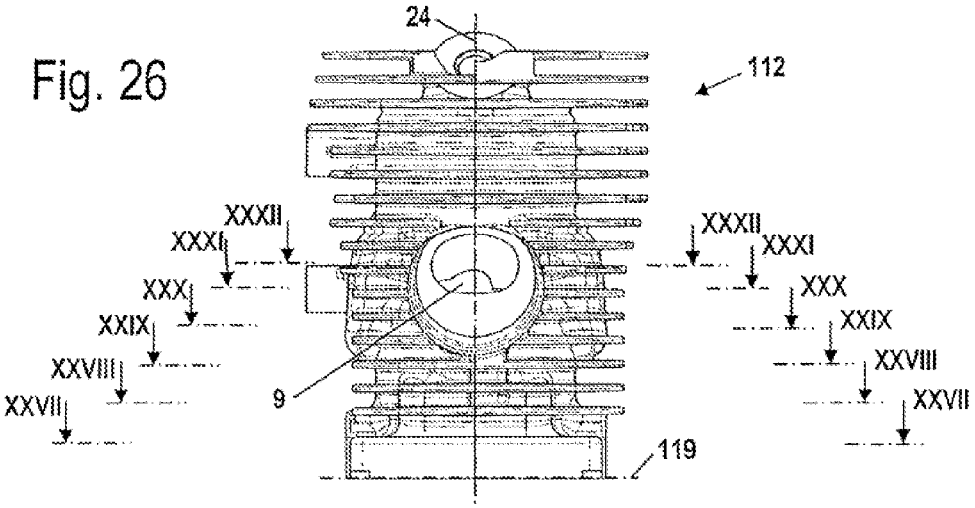

TWO-STROKE ENGINE, SAND CORE FOR PRODUCING A TWO-STROKE ENGINE, AND METHOD FOR OPERATING A TWO-STROKE ENGINE

BACKGROUND OF THE INVENTION

The invention concerns a two-stroke internal combustion engine, a sand core for producing a two-stroke engine, and a method for operating a two-stroke internal combustion engine.

A two-stroke engine with oppositely arranged transfer passages is disclosed in EP 1 135 585 B1. The transfer passages are guided in the crankcase about the circumference of the crankshaft. In the cylinder the transfer passages are guided, coming from opposite cylinder sides, to a location below the outlet of the combustion chamber. In order to dispose both transfer passages within the crankcase, a separate insert is provided which separates the transfer passages from each other and from the crankcase interior.

The object of the invention is to provide a two-stroke engine that has a simple configuration and low exhaust gas values. Another object of the invention resides in providing a sand core for producing the two-stroke engine with which the two-stroke engine is producible in a simple way with minimal manufacturing tolerances. Another object of the invention resides in providing a method for operating a two-stroke engine with which low exhaust gas values are reached.

SUMMARY OF THE INVENTION

According to a first embodiment, this object is solved with regard to the two-stroke internal combustion engine (in the following referred to as two-stroke engine) by a two-stroke engine comprising a cylinder with a combustion chamber disposed therein that is delimited by a piston reciprocatingly supported in the cylinder, wherein the piston drives a crankshaft that is rotatably supported in a crankcase, wherein the crankcase in at least one position of the piston is connected with the combustion chamber by at least two transfer passages that each open by means of a piston-controlled transfer port into the combustion chamber, wherein the two-stroke engine has an inlet into the crankcase and an outlet from the combustion chamber, wherein the two-stroke engine is dividable into four sectors that extend parallel to the cylinder axis, wherein a first sector is provided with a transfer port of a first transfer passage, a second sector adjoining the first sector is provided with the outlet, a third sector adjoining the second sector is provided with a transfer port of a second transfer passage, and a fourth sector located between the first sector and the third sector, is provided with the inlet into the crankcase, and wherein the first and second transfer passages in the cylinder pass together, at a spacing to the separation plane between the cylinder and the crankcase, into a common sector adjoining the sector with the transfer ports.

It has been found that by the proposed arrangement of the transfer passages around the combustion chamber, in particular in a spiral shape, low exhaust gas values of the two-stroke engine can be achieved. The manufacture of the two-stroke engine can be simplified when both transfer passages are combined at their end connected to the crankcase. A common passage segment can thus be formed for a section of the transfer passages. Particularly when producing the two-stroke engine by pressure die casting only one sand core or a common core must be provided for the common passage segment.

Advantageously, both transfer passages are joined at the separation plane between cylinder and crankcase. Within the cylinder the transfer passages can be configured as separate passages. In the separation plane a common opening is provided for both transfer passages where both transfer passages pass into the crankcase. In the crankcase only a single passage must therefore be embodied for both transfer passages. This simplifies the production of the crankcase. However, it can be provided also that both transfer passages are already joined within the cylinder. In this connection, it can be provided that the transfer passages are embodied only within the cylinder and do not pass into the crankcase. However, it can be also provided that both transfer passages together pass into the crankcase. Since both transfer passages are joined in the cylinder, a common core for both transfer passages can be used for producing the cylinder by pressure die casting. In this way the precision with regard to the manufacture of the cylinder is improved. The inaccuracies which may originate from positioning of two individual sand cores relative to each other are avoided.

Advantageously, the radially outwardly positioned outer walls of the transfer passages and the radially inwardly positioned inner walls of the transfer passages are formed about at least one section of the length of the transfer passages as concentric circular segments relative to the longitudinal cylinder axis. The inner walls and the outer walls of the transfer passages thereby extend concentrically to the cylinder bore so that a constant spacing is provided between the inner walls and the outer walls as well as between the inner walls and the wall of the cylinder bore. In this way, material accumulations can be avoided in the cylinder. Over all, the cylinder can be constructed in a more compact configuration and with low weight. The production of the cylinder by means of a casting process is simplified on account of the concentric arrangement in that material accumulations are avoided. Moreover, it has been found that by limiting the transfer passages by circular segments concentrically positioned relative to the longitudinal cylinder axis good flow properties are achievable in the transfer passages that result in low exhaust gas values of the two-stroke engine. Advantageously, the inner walls and the outer walls extend in this connection about a large part of the length of the transfer passages as concentric circular segments relative to the longitudinal cylinder axis. Advantageously, the inner walls and the outer walls deviate from the circular segment shape only in the sections adjoining transfer ports. In this area the course of the transfer passages is selected advantageously such that favorable inflow angles result for a complete scavenging of the combustion chamber.

It is provided that the crankcase is formed of two half shells that have a joining plane extending parallel to the longitudinal cylinder axis. In this connection, the joining plane extends in particular perpendicularly to the axis of rotation of the crankshaft. Expediently, the transfer passages extend within the crankcase within the joining plane of the crankcase. In this way, the transfer passages can be produced by cores that are moveable parallel to the axis of rotation of the crankshaft. In this connection, the transfer passages can be separated from the crankcase interior by a wall section that is integrally formed with the crankcase. Separate components for the separation of the transfer passages from the crankcase interior can be eliminated. The production and assembly are thus simplified. The number of the required individual parts is reduced. A simple configuration also results when the transfer passages are formed in the crankcase by a depression embodied in the crankcase and a collar provided on the cylinder and projecting past the separation plane into the crankcase. An extension of the transfer passages into the crankcase can thus be achieved in an easy way, without additional components being needed.

Advantageously, the cylinder has four transfer ports and two transfer ports are arranged in the first sector and two transfer ports in the third sector of the two-stroke engine. Advantageously, two transfer passages are joined in the second sector and two transfer passages are joined in the fourth sector. In this connection, the two inlet-side transfer passages are guided advantageously below the inlet and the two outlet-side transfer passages below the outlet. Since the transfer passages are guided to a location below the inlet and below the outlet, the width of the two-stroke engine is reduced in the direction of the crankshaft axis. In the area of the crankshaft axis the cylinder bottom can be formed to be narrow. In case of two-stroke engines where the transfer passages extend approximately parallel to the longitudinal cylinder axis toward the crankcase, it is necessary to make available extra space for the transfer passages at the cylinder, the cylinder bottom, and the crankcase laterally of the crank webs. This extra width can be eliminated when the transfer passages are guided to a location below the inlet and the outlet.

However, it can be also provided that all four transfer passages are joined in the fourth sector, i.e. at the inlet side. Only a single passage segment must therefore be embodied in the crankcase for all four transfer passages. Advantageously, all four transfer passages are joined in the second sector. Since all four transfer passages extend to a location below the outlet, there is plenty of space available at the inlet side of the two-stroke engine. This provides favorable installation conditions. It has been found that the combustion chamber scavenging action is improved when the transfer passages are extended to a point below the outlet.

It is provided that two transfer passages whose transfer ports open within the same sector have different passage lengths. When disposing all transfer passages within a common sector, the different passage lengths result on account of the different distance of the transfer port to this sector. In case of two-stroke engines where two transfer passages each are guided toward the outlet and two transfer passages each are guided toward the inlet, it is possible by means of different configurations of the transfer passages to generate different transfer passage lengths in a targeted fashion in order to achieve in this way an improved combustion chamber scavenging action. Advantageously, the transfer passage that opens at the inlet-near transfer port is longer than the transfer passage that opens at the outlet-near transfer port. Advantageously, the two transfer ports arranged in the same sector have different control timing. In this connection, in particular the transfer port of the longer transfer passage, especially the transfer port close to the inlet, opens before the transfer port of the shorter transfer passage, advantageously before the transfer port close to the outlet. In case of a two-stroke engine where the transfer passage close to the inlet is longer, the scavenging action of the transfer passage close to the inlet takes correspondingly longer. To compensate this, it can be provided that the transfer passage close to the inlet opens earlier. In this way, turbulences can be avoided at the same time in the area where the two transfer passages join each other. A uniform scavenging action of the transfer passages can be achieved.

Advantageously, two transfer passages whose transfer ports open in the same sector are joined to a common passage. In this way, the two transfer passages that are arranged side by side in the same sector can be joined first and subsequently the two common passages extending on each side of the cylinder can be combined above the crankcase to a common channel. All four transfer passages of the two-stroke engine can thus open through a common channel into the crankcase. Advantageously, the transfer passages are joined at a distance to the separation plane of cylinder and crankcase to form a common channel. In this connection, the transfer passages are joined expediently in the sector in which the transfer ports of the transfer passages are arranged. Therefore, the transfer passages are already joined at a small distance behind the transfer port so that the transfer passages extend as a common channel for a considerable length.

It is provided that the two-stroke engine has a supply passage for the supply of scavenging air. Advantageously, the supply passage opens at the cylinder and the piston has a piston recess and the piston recess connects the supply passage with a transfer port close to the inlet while a transfer port close to the outlet is connected with the crankcase interior through the piston. Therefore, only the transfer passage close to the inlet is connected directly with the supply passage. Since both transfer passages arranged side by side are connected with each other, the transfer passage close to the outlet can be filled through the transfer passage dose to the inlet with scavenging air. A uniform filling and scavenging of the transfer passages can be achieved in this way. As a result of the communication with the crankcase interior, complete scavenging is possible.

When the transfer passages are connected with a supply passage for the supply of scavenging air, for unequal lengths of the transfer passages a non-uniform scavenging action can result. To avoid this, it is provided that in at least one position of the piston a transfer port is still sealed completely, while a neighboring transfer port, on the same side of the cylinder, is already connected through the piston recess with the supply passage. In this connection, in particular the transfer port that is arranged at the longer transfer passage is already connected with the supply passage. In case of the transfer passages extending below the outlet, particularly the transfer port close to the outlet is still sealed while the transfer port close to the inlet is already connected with the supply passage. In order to reach a uniform scavenging action of the transfer passages, it is in particular provided that the piston recess has an upper edge whose spacing to the piston bottom changes in circumferential direction of the piston. In case of two transfer ports to be connected with a piston recess, it is thus possible that one transfer port, in particular the transfer port assigned to the longer transfer passage, is scavenged first. By an appropriately adjusted arrangement of the upper edge of the piston recess it is possible that a uniform front of scavenging air results when the two transfer passages are joined.

However, an inclined or displaced upper edge of a piston recess can also be advantageous when only one transfer passage is connected with the piston recess. By means of a non-uniform upper edge of the piston recess, especially an edge that is inclined toward the longitudinal cylinder axis, it is possible to compensate length differences within a transfer passage in the circumferential direction. Thus, the area of the transfer passage that is arranged adjacent to the inlet in case of a transfer passage that is guided below the outlet can be connected first with the supply passage. A uniform scavenging air front can thereby be achieved in the transfer passages. Turbulence in the transfer passage can be avoided so that a good and complete scavenging of the transfer passage results.

In order to achieve a good combustion chamber scavenging action, it is provided that at least one transfer passage is guided in the cylinder such that the mouth at the cylinder bottom has a wide side extending parallel with the crankshaft axis and a narrow side that is measured perpendicularly thereto. Moreover, the length of the wide side decreases in cross-sections perpendicularly to the direction of flow toward the transfer port and the length of the narrow side increases in cross-sections perpendicularly to the direction of flow toward the transfer port. Known transfer passages are twisted when guided around the cylinder. Instead of twisting the passages, it is now provided to narrow continuously the wide side and to continuously widen the narrow side so that another shape of the transfer passage is formed at the transfer port.

A separation of the flow in the transfer passage can be avoided by the suggested design of the transfer passage. This is achieved in that the difference between the outer radius and the inner radius in the transfer passage can be kept minimal by the suggested design. In case of engines operating with scavenging air the exhaust gas values can be improved in this way because mixing of the scavenging air with fuel/air mixture can be avoided substantially.

In this connection, it is advantageous when in the cross-section that is neighboring the transfer port and is positioned perpendicularly to the direction of flow the length of the wide side is smaller than the length of the narrow side. When at the cylinder bottom the wide side is wider than the narrow side, i.e., the transfer passage in cross-section is elongate in the direction toward the axis of rotation of the crankshaft, the transfer passage neighboring the transfer port is oriented transversely to the axis of rotation of the crankshaft. In order to provide a transition that is favorable with respect to flow between the mouth at the cylinder bottom and the transfer passage, it is provided that the product of the length of the wide side and the length of the narrow side is roughly the same for every cross-section of the transfer passage perpendicular to the direction of flow.

With regard to the sand core the object is solved in that the sand core has sections that mold at least two transfer passages positioned in two opposed sectors of the two stroke engine of the first embodiment.

Since a single sand core is used for molding or forming at least two transfer passages arranged in opposed sectors is used, the position of the transfer passages relative to each other is fixed by the sand core. Tolerances are eliminated that are caused by positioning relative to each other separately embodied sand cores for the opposed transfer passages. Advantageously, a sand core is provided for molding all transfer passages in the cylinder.

Advantageously, the sand core has at least one connecting segment that connects those segments of the sand core with each other that mold the ends of the transfer passages that are arranged in opposite sectors and face the combustion chamber. The connecting segment is arranged in the area of the cylinder bore of the finished cylinder. By means of the connecting segment arranged in this area the stability of the sand core can be increased because the sand core connects the oppositely positioned transfer passages with each other at its end facing the crankcase as well as at its end facing the transfer ports.

With regard to the method, the object is solved with a method for operating a two-stroke engine that has a combustion chamber embodied in a cylinder which is delimited by a piston reciprocatingly supported in the cylinder and driving a crankshaft supported rotatably in a crankcase, wherein the crankcase is connected in at least one position of the piston by means of at least two transfer passages with the combustion chamber, which transfer passages open with a piston-controlled transfer port into the combustion chamber, respectively, wherein the two-stroke engine has an inlet into the crankcase and an outlet from the combustion chamber, wherein the two-stroke engine is dividable into four sectors extending parallel to the longitudinal cylinder axis, wherein in a first sector two transfer ports of the transfer passages are provided, wherein in a second sector adjoining the first sector the outlet is provided, and in a fourth sector, adjoining the other side of the first sector opposite the second sector, the inlet is provided, wherein the two transfer passages are joined to form a common channel, and a supply passage is provided for the supply of scavenging air which supply passage opens at the cylinder, and wherein the piston has a piston recess, it is provided that the transfer port of the inlet-near transfer passage is connected, in the area of the top dead center of the piston, by the piston recess with the supply passage; that scavenging air is supplied into the inlet-near transfer passage; and that through the inlet-near transfer passage the scavenging air is supplied into the outlet-near transfer passage.

Since only to one of the two transfer passages connected to each other scavenging air is supplied, a good, uniform scavenging action of the transfer passages can be achieved. Turbulences that may be generated in the connecting area of the transfer passages are avoided.

The object of the present invention is further solved according to a second embodiment with regard to the two-stroke engine by a two-stroke engine comprising a cylinder with a combustion chamber disposed therein that is delimited by a piston reciprocatingly supported in the cylinder, wherein the piston drives a crankshaft that is rotatably supported in a crankcase, wherein the crankcase in at least one position of the piston is connected with the combustion chamber by at least two transfer passages which transfer passages each open by means of a piston-controlled transfer port into the combustion chamber, wherein the two-stroke engine has an inlet into the crankcase and an outlet from the combustion chamber, wherein the two-stroke engine is dividable into four sectors that extend parallel to the cylinder axis, wherein a first sector is provided with two transfer ports of the transfer passages, a second sector adjoining the first sector is provided with the outlet, and a fourth sector that adjoins the first sector at a side remote from the second sector is provided with the inlet, and wherein the transfer passages are combined to a common channel, wherein a supply passage for supplying scavenging air is provided that opens at the cylinder and wherein the piston has a piston recess, wherein the piston recess is arranged in the area of the transfer port of the inlet-near transfer passage and does not extend into the area of the transfer port of the outlet-near transfer passage.

With the second embodiment of a two-stroke engine as set forth, a scavenging action of the outlet-near transfer passage through the inlet-near transfer passage is realized in an easy way.

The object is further solved according to a third embodiment with regard to the two-stroke engine by a two-stroke engine comprising a cylinder with a combustion chamber disposed therein that is delimited by a piston reciprocatingly supported in the cylinder, wherein the piston drives a crankshaft that is rotatably supported in a crankcase, wherein the crankcase in at least one position of the piston is connected with the combustion chamber by at least two transfer passages which transfer passages each open by means of a piston-controlled transfer port into the combustion chamber, wherein the two-stroke engine has an inlet into the crankcase and an outlet from the combustion chamber, wherein the two-stroke engine has a center plane in which the longitudinal cylinder axis is positioned and that divides the outlet, wherein the transfer ports of the two transfer passages are positioned on one side of the center plane, and wherein the two-stroke engine has a supply passage for supplying scavenging air, wherein the two transfer passages are combined to a common channel and wherein the transfer ports upon downward stroke of the piston open sequentially (one after the other) toward the combustion chamber.

With the third embodiment of a two-stroke engine as set forth above, a uniform scavenging action of the transfer passages can be achieved. The different control timing enables compensation of different pressure conditions in the transfer passages on the basis of different transfer passage lengths and avoidance of turbulences in the area where the two transfer passages are connected with each other by the different control timing of the two transfer passages.

It is provided that the piston has a planar piston bottom and that the control edges of the transfer ports facing the combustion chamber top have different spacings to the piston bottom at bottom dead center of the piston. Different control timing of the transfer passages can be realized easily in this manner. Advantageously, at bottom dead center of the piston the distance of the control edge of the inlet-near transfer passages to the piston bottom is greater than the distance of the control edge of the outlet-near transfer passage to the piston bottom. With this configuration, the inlet-near transfer passage opens before the outlet near transfer passage.

BRIEF DESCRIPTION OF THE DRAWINGS

Embodiments of the invention are explained in the following with the aid of the drawing.

FIG. 23 is a schematic, perspective representation of a cylinder of a two-stroke engine, FIG. 24 is a perspective representation of a sand core for producing the transfer passages of the cylinder of FIG. 23, FIG. 25 is a side view of the sand core of FIG. 24, FIG. 26 is a side view of the cylinder of FIG. 23.

DESCRIPTION OF PREFERRED EMBODIMENTS

Figure 1:
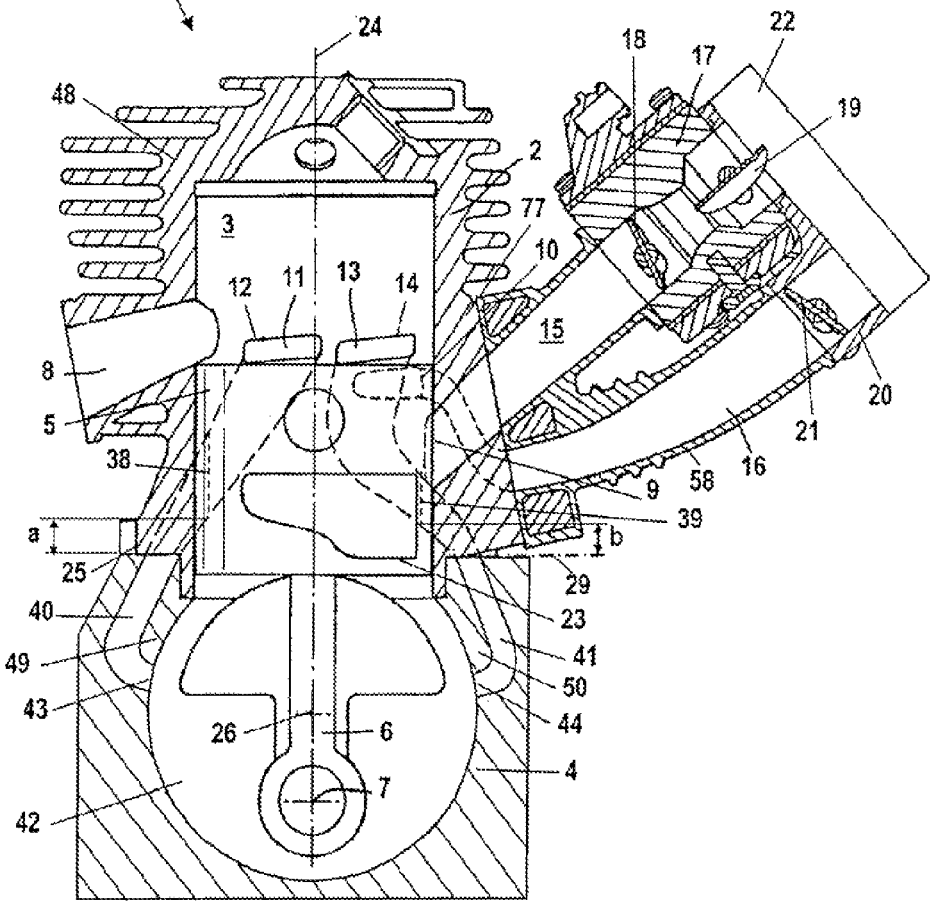
FIG. 1 is a schematic section representation of a two-stroke engine.

FIG. 1 shows a two-stroke engine 1 in a schematic illustration which has a cylinder 2 in which a combustion chamber 3 is embodied. The two-stroke engine 1 is in particular arranged in a hand-guided power tool like a motor chain saw, a cut-off machine, or the like and serves for driving the tool of the power tool. The combustion chamber 3 is delimited by a piston 5 that is supported in the cylinder 2 so as to reciprocate in the direction of longitudinal cylinder axis 24. The piston 5 drives by connecting rod 6 a crankshaft 7 supported rotatably in a crankcase 4 about axis of rotation 26. The combustion chamber 3 fluidically communicates through a total of four transfer passages 11, 13 with the crankcase interior 42 at bottom dead center of the piston 5, as shown in FIG. 1. At the cylinder 2 a mixture channel 15 with a mixture inlet 9 opens. The two-stroke engine 1 is embodied symmetrically to a center plane 48 that represents the section plane of FIG. 1. At the cylinder 2 a supply passage 16 in which scavenging air substantially free of fuel is guided opens below a transfer port 14 of the transfer passage 13 neighboring the mixture inlet 9.

The supply passage 16 branches in the area of a connection flange 77 of the cylinder 2 into two branches that each open with a supply passage inlet 10 at the cylinder 2 at the side of a transfer port 14 facing the crankcase 4. An outlet 8 is provided at the combustion chamber 3. The transfer passages 11 neighboring or proximal to the outlet 8 open with transfer ports 12 into the combustion chamber 3.

The mixture channel 15 and the supply passage 16 are connected to an air filter 22. The mixture channel 15 is connected through a carburetor 17 with the air filter 22. In the carburetor 17 fuel is supplied to the combustion air that has been sucked in through the air filter 22. In the carburetor 17 a throttle valve 18 and upstream of the throttle valve 18 a choke flap 19 are pivotably supported. The supply passage 16 is connected with a supply passage component 20 to the air filter 22. In the supply passage component 20 a control flap 21 is pivotably supported and controls the amount of scavenging air supplied to the two-stroke engine 1. The position of the control flap 21 may be coupled to the position of the throttle valve 18. The mixture channel 15 and the supply passage 16 are embodied between the carburetor 17 or the supply passage component 20 and the connecting flange 77 in a common connecting socket 58.

Figure 3:
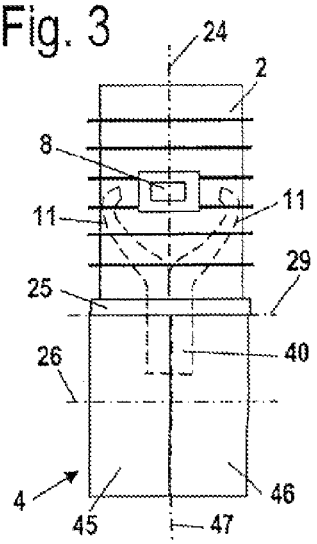
FIG. 3 is a schematic illustration of the two-stroke engine of FIG. 1.

As shown in FIG. 3, the cylinder 2 is connected at a separation plane 29 with the crankcase 4. As shown in FIG. 3, the crankcase 4 comprises two crankcase shells 45 and 46 that are connected with each other at a joining plane 47. The joining plane 47 extends perpendicularly to the axis of rotation 26 of the crankshaft 7 and perpendicularly to the separation plane 29. In the illustrated embodiment, the joining plane 47 extends within the center plane 48. However, the joining plane 47 can be arranged relative to the center plane 48 so as to be displaced in parallel.

Figure 2:
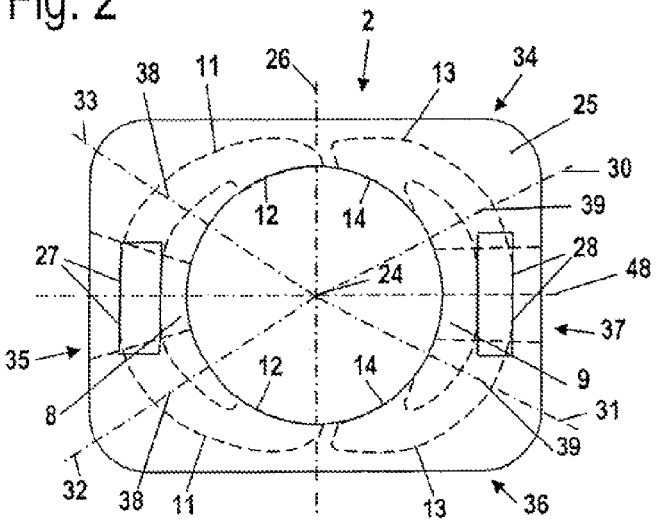
FIG. 2 is a schematic illustration of the cylinder of the two-stroke engine of FIG. 1 at the cylinder bottom.

As shown in FIGS. 1 to 3, the outlet-near transfer passages 11, i.e., proximal to the outlet and remote from the inlet, are guided in the cylinder 2 spirally around the cylinder 2 below the outlet 8. At the cylinder bottom 25 the transfer passages 11 open each with a mouth 27. Both mouths 27 are joined at the cylinder bottom 25 to a common opening. In the crankcase 4 both transfer passages 11 are guided in a common passage segment 40 that opens with an opening 43 into the crankcase interior 42. In the common passage segment 40 no separation is provided between both outlet-near transfer passages 11. The common passage segment 40 can therefore be produced in a simple way.

The inlet-near transfer passages 13, i.e., proximal to the inlet and remote from the outlet, are joined below the mixture inlet 9. The inlet-near transfer passages 13 are guided spirally around the cylinder 2 below the mixture inlet 9. Each transfer passage 13 opens with a mouth 28 at the cylinder bottom 25. Both mouths 28 are joined at the cylinder bottom 25 to a common opening. In the crankcase 4 the two inlet-near transfer passages 13 are guided in a common passage segment 41 that extends in the joining plane 47 between the two crankcase shells 45 and 46 and opens with an opening 44 into the crankcase interior 42.

As shown in FIG. 2, the outlet 8 and the mixture inlet 9 are arranged on opposite sides of the cylinder 2. Between the outlet 8 and the mixture inlet 9 there are on the inner circumference of the cylinder 2 a transfer port 12 and a transfer port 14, respectively. The cylinder 2 may be divided by four imaginary dividing planes 30, 31, 32, 33 that extend parallel to the longitudinal cylinder axis 24 and contain the longitudinal cylinder axis 24, respectively, into four imaginary sectors 34, 35, 36, 37. In this connection, the first sector 34 contains two transfer ports 12, 14. In the schematic view of the cylinder 2 from below shown in FIG. 2 a second sector 35 follows in counterclockwise direction and contains the outlet 8. This sector 35 is adjoined by a third sector 36 that relative to the center plane 48 is symmetric to the first sector 34. Between the third sector 36 and the first sector 34 a fourth sector 37 is arranged which is delimited by the dividing planes 30 and 31. In this connection, the outlet 8, the mixture inlet 9, and the transfer ports 12, 14 are arranged in each case completely within the sectors 34, 35, 36, 37 and are not intersected by the dividing planes 30, 31, 32, 33.

The transfer passage 11 arranged in the first sector 34 passes at a junction 38 through the imaginary dividing plane 33 from the first sector 34 into the second sector 35. Likewise, the outlet-near transfer passage 11 that opens in the third sector 36 passes at junction 38 through the dividing plane 32 from the third sector 36 into the second sector 35. As shown in FIG. 1, each junction 38 has relative to the separation plane 29 a distance a that is measured parallel to the longitudinal cylinder axis 24. Therefore, the transfer passages 11 enter above the separation plane 29 the second sector 35 that encompasses the outlet 8. The transfer passages 11 are not guided around the circumference of the cylinder 2 in the separation plane 29 but extend instead in a spiral shape within the cylinder 2. Accordingly, both inlet-near transfer passages 13 pass from the first sector 34 or the third sector 36 at junctions 39 through the dividing plane 30 or the dividing plane 31 into the fourth sector 37. The junctions 39 have, as shown in FIG. 1, a distance b to the separation plane 29 that is measured parallel to the longitudinal cylinder axis 24. The inlet-near transfer passages 13 also pass above the separation plane 29 into the fourth sector 37.

The spiral extension of the transfer passages results in favorable flow properties. It has been found that by this configuration of the transfer passages 11, 13 the exhaust gas values of the two-stroke engine 1 can be clearly improved. Moreover, material accumulations on the cylinder 2 are avoided by the spiral-shaped course of the transfer passages 11, 13 so that a low weight of the two-stroke engine 1 results. Since the transfer passages in the crankcase 4 extend below the mixture inlet 9 and the outlet 8, the cylinder bottom 25 can be made narrow in the direction of the axis of rotation 26. Below mixture inlet 9 and outlet 8 enough space must be available at the cylinder bottom 25 for the mouths 27 and 28. However, enough space is available in this area anyway because of the provided arrangement of mixture inlet 9 and outlet 8. The two-stroke engine 1 can therefore be of a compact configuration and can be provided with minimal width.

In operation of the two-stroke engine 1 in the area of the top dead center of the piston 5 fuel/air mixture is sucked in through the mixture inlet 9 into the crankcase interior 42. In this position of the piston 5 the supply passage inlet 10 is connected by piston recess 23 arranged on the outer periphery of the piston with the transfer ports 12 and 14. In this connection, the piston 5 is provided in the first sector 34 as well as in the third sector 36 with a piston recess 23, respectively, for the transfer ports 12, 14 arranged in this area. Through the piston recess 23 scavenging air from the supply passage 16 is supplied to the transfer passages 11 and 13. With the downward stroke of the piston 5 the fuel/air mixture is compressed in the crankcase 42. As soon as the transfer ports 12 and 13 are opened by the piston 5, scavenging air flows first from the transfer passages 11 and 13 into the combustion chamber 3 and scavenges exhaust gases from the preceding cycle from the combustion chamber 3 through the outlet 8. Subsequently, fresh mixture flows from the crankcase interior 42 into the combustion chamber 3. With the upward stroke of the piston 5 the fuel/air mixture is compressed in the combustion chamber 3 and is ignited in the area of the top dead center of the piston 5 by a spark plug, not shown. The piston 5 is accelerated by the ignition in the direction of the crankcase 4. As soon as the outlet 8 opens, exhaust gases can stream out from the combustion chamber 3. Residual gases are scavenged by the incoming scavenging air as soon as the transfer ports 12 and 14 open. Subsequently, fresh mixture flows in for the next cycle.

When scavenging air is supplied, the transfer passages 11 and 13 are flowed through from the transfer ports 12 and 14 in the direction of the crankcase 4. In this connection, the transfer passages 11, 13 are advantageously so designed that no scavenging air will pass into the crankcase 4. When mixture passes from the crankcase 4 into the combustion chamber 3, the transfer passages 11, 13 are flowed through in opposite direction. In order to obtain a sufficient fill of the transfer passages with scavenging air at the usually very high engine speeds of the two-stroke engine 1 and to introduce at the same time a sufficient amount of fuel/air mixture into the combustion chamber 3, the transfer passages 11, 13 have a favorable fluidic design. Moreover, the transfer passages 11, 13 are so formed that a separation of the flow is avoided in the transfer passages 11, 13. In this way, the scavenging air flowing into the transfer passages 11, 13 fills out the entire cross-section of the transfer passages 11, 13. This provides for a good separation of the fresh mixture from the exhaust gases in the combustion chamber 3.

Figure 4:
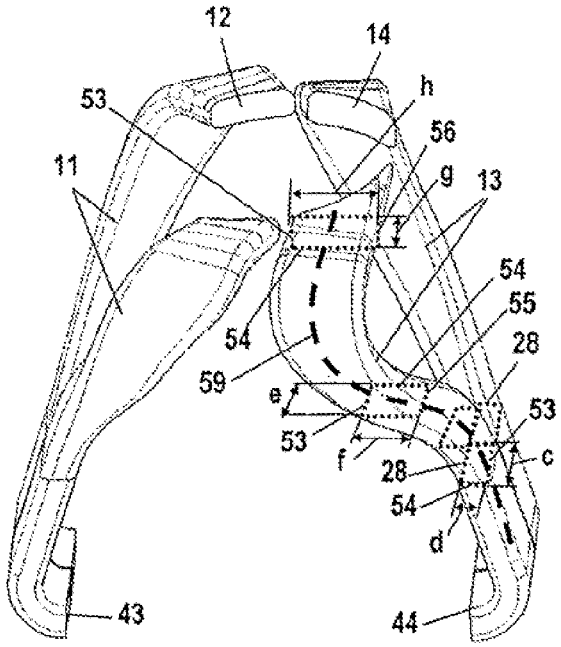
FIG. 4 is a perspective illustration of the transfer passages of the two-stroke engine of FIG. 1.

The design of the transfer passages 11, 13 is shown in FIG. 4. Here only the contour of the transfer passages 11, 13 is shown. The fluidically favorable extension is illustrated with the aid of an inlet-near transfer passage 13. The outlet-near transfer passages 11 are embodied accordingly. As shown in FIG. 4, the transfer passages have at the mouth 28 an elongate cross-section. In this connection, the mouths 28 are oriented in the direction of the axis of rotation 26 (FIG. 1). The transfer passages 13 have at the mouth 28 a wide side 53 which has a length c. The wide side 53 is measured in parallel to the axis of rotation 26. Perpendicularly thereto the transfer passages 13 have a narrow side 54 which has a length d. The length d is considerably smaller than the length c.

In FIG. 4 the direction of flow 59 in the transfer passages 13 is shown schematically. Moreover, several cross-sections 55, 56 that are perpendicular to the direction of flow 59 are shown. As shown in FIG. 4, the length d of the narrow side 54 increases continuously from the mouth 28 to the transfer port 14, while the length c of the wide side 53 continuously decreases. In a cross-section 55 which is positioned between the mouth 28 and the transfer port 14, the wide side 53 has a length e that is a little smaller than a length f of the narrow side 54. In a cross-section 56 that is neighboring the transfer port 14, the wide side 53 has a length g which is significantly smaller than a length h of the narrow side 54. In this connection, the wide side 53 is positioned approximately in the direction toward the longitudinal cylinder axis 24 (FIG. 1). In order to achieve a steady transition from the mouth 28 to the transfer port 14, it is provided that the product of the length c, e, g of the wide side 53 and of the length d, f, h of the narrow side 54 of each cross-section 55, 56 is constant. Between the mouth 28 and the cross-section 56 neighboring the transfer port 14, the transfer passage 13 has a cross-section in which the length of the wide side 53 and the length of the narrow side 54 are the same.

Figure 5:
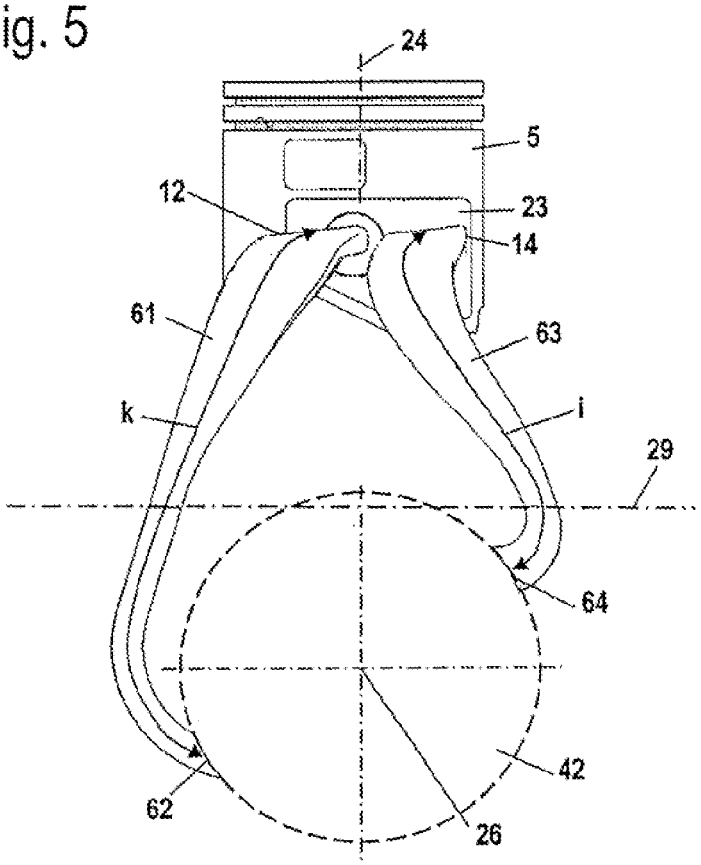
FIG. 5 is a schematic side view of an embodiment of the transfer passages of the two-stroke engine of FIG. 1.

In order to achieve a good tuning of the two-stroke engine 1, the lengths of the transfer passages 11 and 13 can be embodied differently. This is shown FIG. 5. Here two outlet-near transfer passages 61 are provided that each have a length k. Two inlet-near transfer passages 63 have a length l that is considerably smaller than the length k of the outlet-near transfer passages 61. The outlet-near transfer passages 61 open with an opening 62 into crankcase interior 42, schematically shown in FIG. 5. The opening 62 is arranged, viewed in the direction of the longitudinal-cylinder axis 24, below the axis of rotation 26 of the crankshaft 7. The inlet-near transfer passages 63 open with an opening 64 into the crankcase interior 42 which opening is arranged above the axis of rotation 26. It has been found that for achieving high engine speeds short transfer passages 63 are favorable, while for achieving high torque long transfer passages 61 are advantageous. Over all improved running behavior of the two-stroke engine 1 can be achieved by the combination of short and long transfer passages. Moreover, by suitable tuning of the lengths of the transfer passages 61, 63, the amount and distribution of the scavenging air within the transfer passages can be controlled.

As shown in FIG. 1, the transfer passages 11 and 13 extend in the crankcase 4 at a distance to the crankcase interior 42. The common passage segments 40 and 41 are separated from the crankcase interior 42 by webs 49 or 50 that are integrally formed in the crankcase 4. In this connection, a section of web 49, 50 can be provided on the crankcase shell 45 and the other section of the web 49, 50 can be provided on the crankcase shell 46, each section being integrally formed. However, it can also be provided to integrally form the entire web 49, 50 on one of the crankcase shells 45 or 46.

Figure 6:
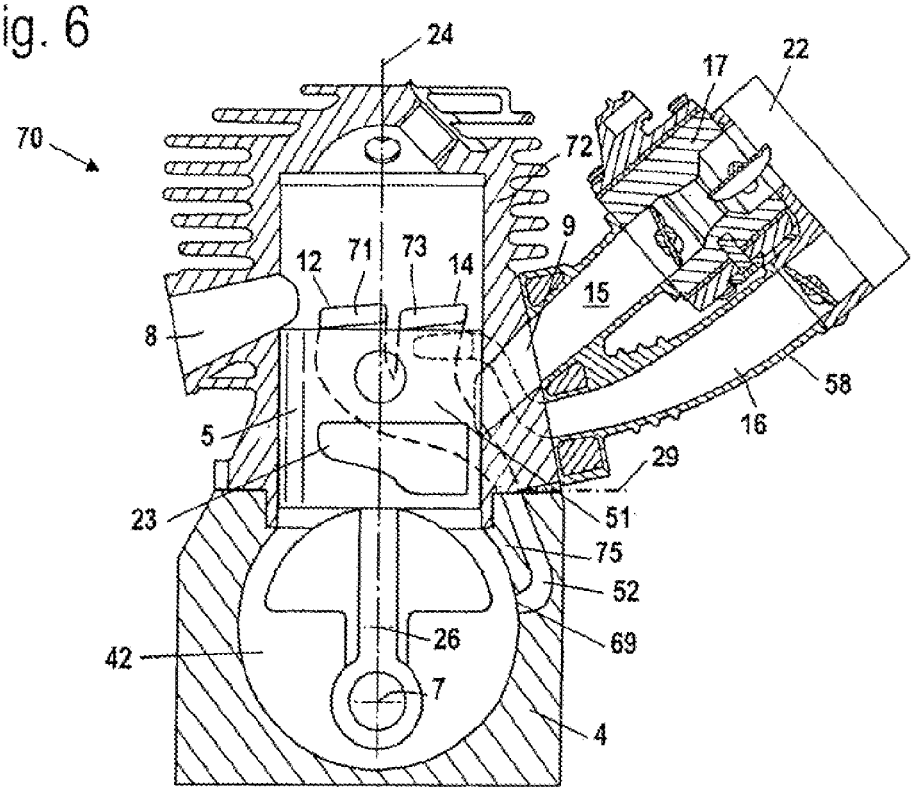
FIG. 6 is a schematic section illustration of an embodiment of a two-stroke engine.

In FIG. 6, another embodiment of a two-stroke engine 70 is shown. The configuration of the two-stroke engine 70 corresponds essentially to the configuration of the two-stroke engine 1 of FIG. 1. Same reference numerals identify the same components. The two-stroke engine 70 has two outlet-near transfer passages 71 that open with transfer ports 12 into the combustion chamber 3 as well as two inlet-near transfer passages 73 that open with transfer ports 14 into the combustion chamber 3. The combustion chamber 3 is embodied in a cylinder 72 of the two-stroke engine 70. As shown in FIG. 6, all transfer passages 71, 73 are guided below the mixture inlet 9. In this connection, two neighboring transfer passages 71, 73 are already joined in the cylinder 72 to a common channel 51. In FIG. 6, the common channel 51 extends from the first sector 34 (FIG. 2) to the fourth sector 37. On the opposite side of the cylinder 72, not shown, a channel 51 that is mirror-symmetrically embodied extends from the third sector 36 to the fourth sector 37. The common channel 51 extends in a spiral shape in the cylinder 72 below the mixture inlet 9. In the crankcase 4 all transfer passages 71, 73, i.e., both channels 51, extend in a common passage segment 52 that opens with an opening 69 into the crankcase interior 42. It may also be provided to have the two channels 51 extend separately in the crankcase 4. In this connection, a seal arranged between both crankcase shells 45, 46 can serve as a separation, for example.

Figure 7:
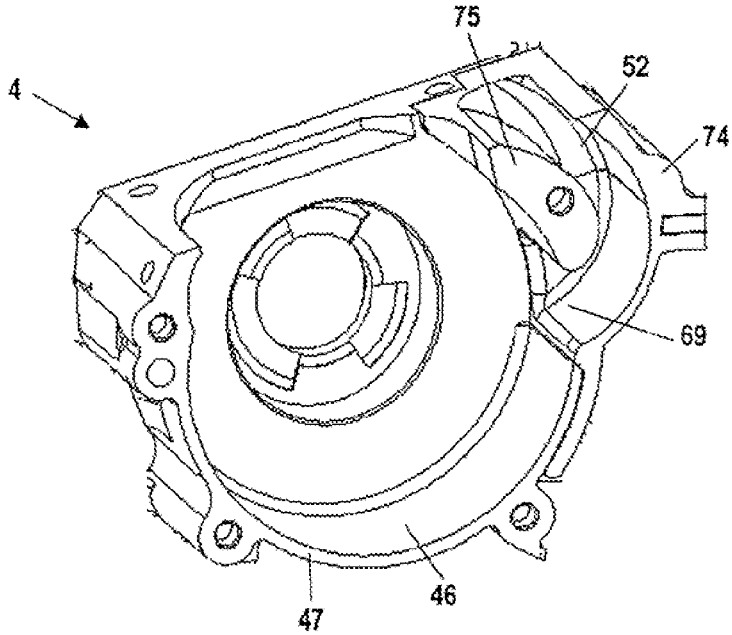
FIG. 7 a perspective representation of a half shell of the crankcase of the two-stroke engine of FIG. 6.

FIG. 7 shows the constructive design of the second crankcase shell 46. The first crankcase shell 45 is embodied symmetrically thereto for a central division of the crankcase 4. The crankcase shell 46 has an insert 74 in which the common passage segment 52 is embodied. On the insert 74 a section of a web 75 is integrally formed which separates the common passage segment 52 from the crankcase interior 42. However, the area embodied on the insert 74 can be embodied also as a one-piece configuration with the crankcase shell 46. The crankcase 4 is produced advantageously by a casting process. Since the transfer passages 71, 73 in the crankcase 4 extend in the common passage segment 52, the crankcase shells 45, 46 can be removed from the mold in the direction of the axis of rotation 26 of the crankshaft, without this requiring additional cores or the like for producing the common passage segment 52. A simplified production of the crankcase 4 is thus provided. Likewise, the common passage segments 40 and 41 of the two-stroke engine 1 of FIG. 1 can be produced in a simple way as a one-piece configuration with the crankcase shells 45 and 46. This simplified production is also possible when the channels 51 in the crankcase 4 are separated from one another by a seal arranged between the crankcase shells 45 and 46.

Figure 8:
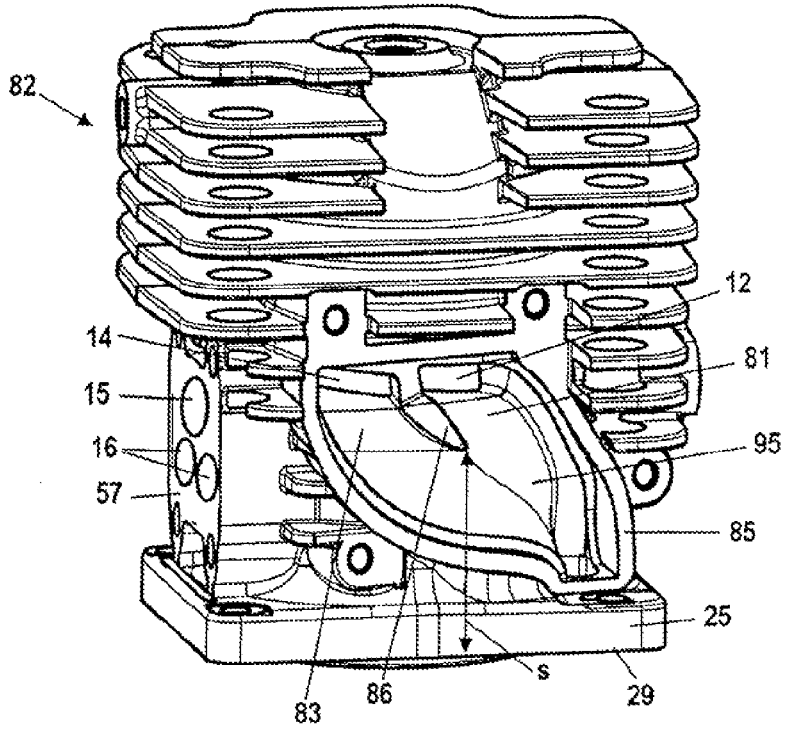
FIG. 8 shows a cylinder of a two-stroke engine in a perspective representation.
Figure 9:
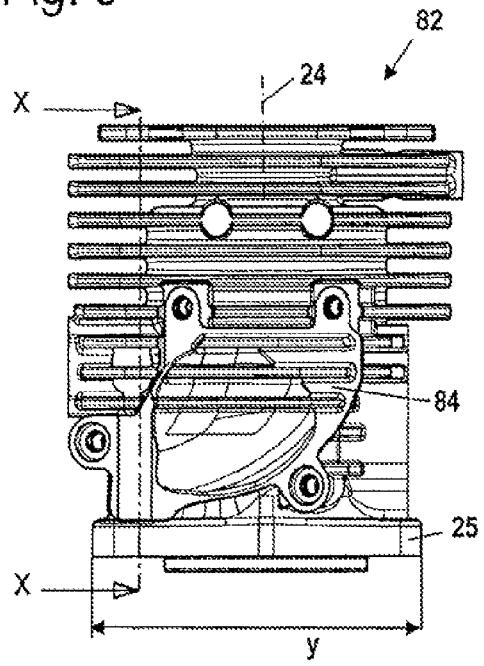
FIG. 9 is a side view of the cylinder of FIG. 8.
Figure 10:
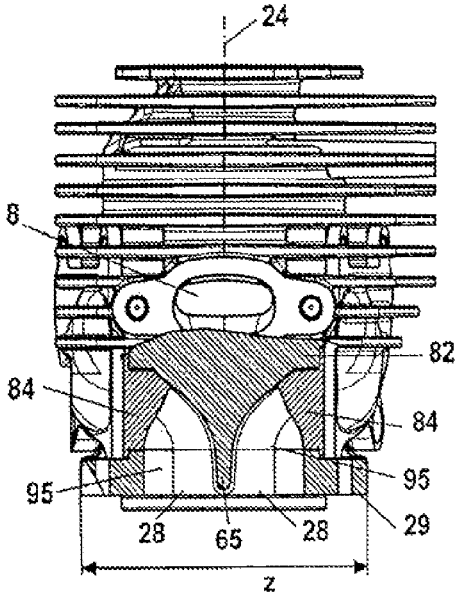
FIG. 10 is a section view along the section line X-X of FIG. 9.

FIGS. 8 to 10 show one embodiment of a cylinder 82. The cylinder 82 has a connecting flange 57 for connecting to a connecting socket 58 (FIG. 1). The mixture channel 15 and the supply passage 18 that is split into two branches open at the connecting flange 57. In the cylinder 82, an outlet-near transfer passage 81 and an inlet-near transfer passage 83 extend on each side of the cylinder 82, respectively. The transfer passages 81 and 83 that are arranged in a common sector of the cylinder 82 are joined to a common channel 95. In the area that adjoins the transfer ports 12, 14 the transfer passages 81 and 83 are separated by a partition 86 from each other. The partition 86 ends at a distance s above the separation plane 29. In this connection, the distance s is greater than the length of the partition 86 so that the transfer passages 81 and 83 extend together about most of their length.

In the cylinder 82 the inner contour of the transfer passages 81 and 83 that is facing the cylinder interior is molded or formed. Toward the exterior the transfer passages 81 and 83 in the cylinder 82 are embodied to be open. The cylinder 82 has on each cylinder side a connecting flange 85 to which the lids 84 shown in FIGS. 9 and 10 can be connected. Each lid 84 seals the two transfer passages 81 and 83 that are arranged adjacent to each other as well as the common channel 95.

As shown in FIG. 10, on the cylinder 82 a wall 65 is integrally formed which separates the common channels 95 on each side of the cylinder 82 from each other. The wall 65 ends at the separation plane 29. In the separation plane 29 the common channels 95 are joined. Since the common channels 95 pass at the cylinder bottom 25 into the crankcase 4 below the outlet 9, the width z of the cylinder bottom 25 shown in FIG. 10 is considerably smaller than the length y shown in FIG. 9 of the cylinder bottom 25. In this connection, the length y is measured perpendicular to the axis of rotation 26 and the width z parallel to the axis of rotation 26 of the crankshaft 7.

Figure 11:
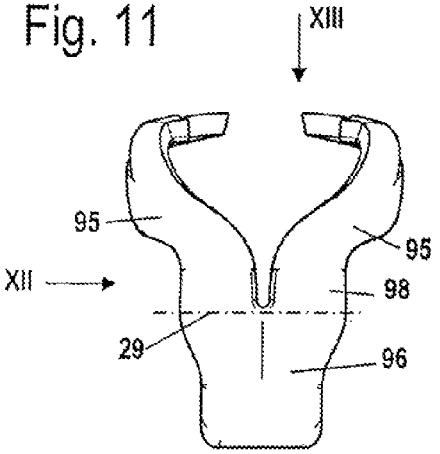
FIG. 11 is a side view of the transfer passages of the cylinder of FIGS. 8 to 10.
Figure 12:
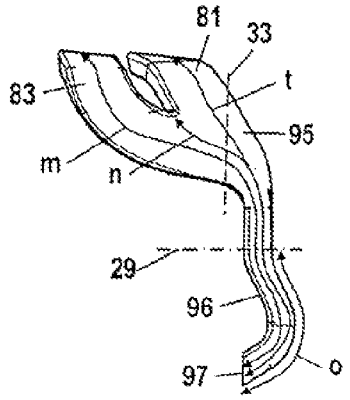
FIG. 12 is a side view in the direction of arrow XII of FIG. 11.
Figure 13:
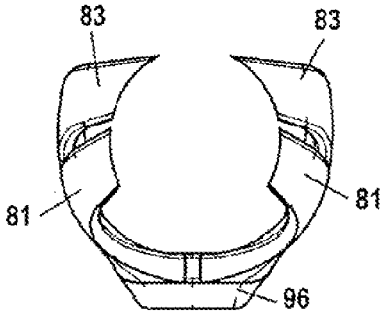
FIG. 13 a plan view of the transfer passages in the direction of the arrow XIII in FIG. 11.
Figure 14:
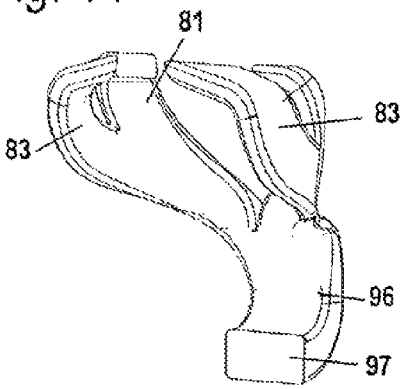
FIG. 14 is a first perspective representation of an embodiment of transfer passages.
Figure 15:
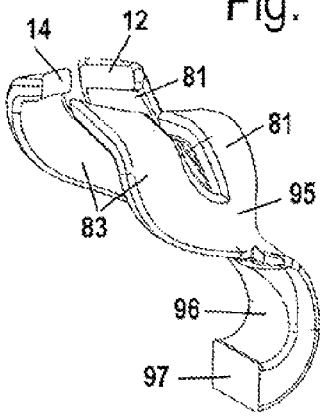
FIG. 15 is a second perspective representation of an embodiment of transfer passages.
Figure 16:
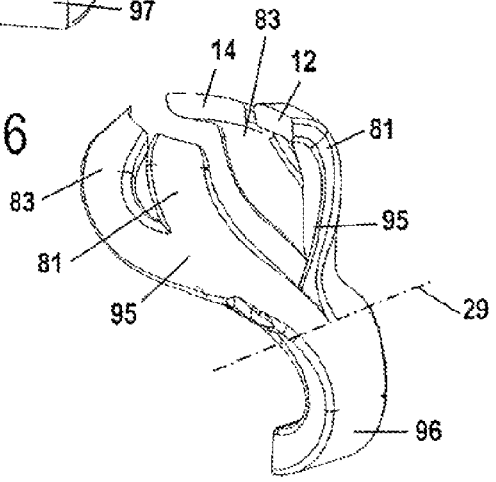
FIG. 16 is a third perspective representation of an embodiment of transfer passages.

FIGS. 11 to 16 show the design of the transfer passages 81 and 83. In this connection, FIGS. 11 to 13 show a first design and FIGS. 14 to 16 show a second design. In the design of the transfer passages 81 and 83 shown in FIGS. 11 to 13, the transfer passages 81 and 83 are separated only about a short section of their length. As shown in FIG. 12, the outlet-near transfer passages 81 have a length t that is a little smaller than the length m of the inlet-near transfer passages 83. The common channel 95 together with the common passage segment 96 in the crankcase 4 of the two channels 95 has a length n which amounts to about 10% up to about 70% of the length m of the inlet-near transfer passage 83. The length o of the common passage segment 96 amounts advantageously to about 5% up to about 70% of the length m of the inlet-near transfer passage 83. The common passage segment 96 opens with an opening 97 into the crankcase interior 42.

As shown in particular in FIGS. 11 and 12, the common channel 95 has a section 98 adjoining the separation plane 29 in which the walls delimiting the common channel 95 extend approximately perpendicularly to the separation plane 29 or open slightly toward the separation plane 29. In this way, this segment 98 of the transfer passages 81, 83 can be molded with a core when producing the cylinder 82 by pressure die casting.

In the design of the transfer passages 81 and 83 illustrated in FIGS. 14 to 16, the transfer passages 81 and 83 are embodied in a twisted shape up to the separation plane 29. The transfer passages 81, 83 extend approximately concentrically around the cylinder bore.

Figure 17:
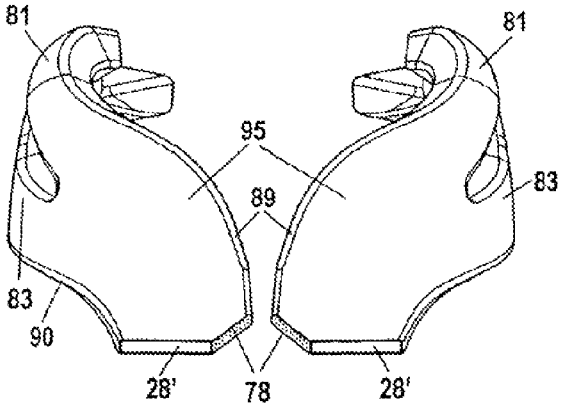
FIG. 17 is a perspective representation of one embodiment of transfer passages with a constricted opening cross-section.

FIGS. 17 to 20 show further embodiments of the transfer passages 81 and 83. FIG. 17 shows transfer passages 81 and 83 that open with mouths 28' into the crankcase; the mouths 28' have, compared with the mouths 28 (FIG. 10), a reduced cross-section. For this purpose, in the area of the mouths 28' there are slanted walls 78 that are arranged at inwardly positioned side walls 89 of the transfer passages 81 that are facing each other. By means of the walls 78 a reduced effective flow cross-section of the common channels 95 and thus a lower throughput of the two-stroke engine results. By means of the walls 78 it is possible to enable designs of the transfer passages 81, 83 for two-stroke engines with different engine displacements. The adaptation of the effective flow cross-section of the transfer passages 81, 83 to the engine displacement of the internal combustion engine can be realized by means of suitable sizing of the walls 78. The walls 78 can be provided, for example, on an insert that is inserted from below, i.e. from the separation plane 29, into the cylinder 82. For the production of the transfer passages 81 and 83 for two-stroke engines with different engine displacements only one transfer passage geometry is thus required. For producing all transfer passages, in case of manufacture by a casting process, the same core, in particular, the same sand core, can be used, respectively. The manufacture is thus simplified.

Figure 18:
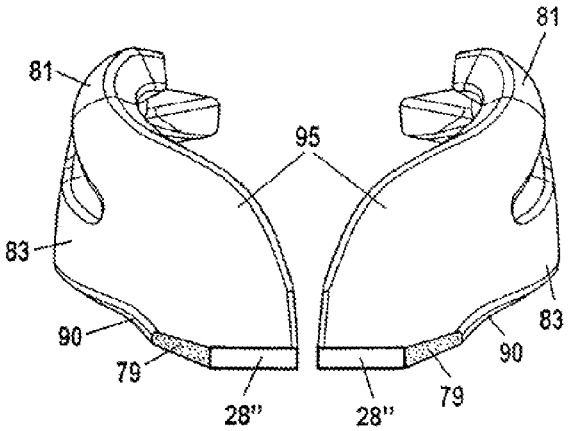
FIG. 18 is a perspective representation of another embodiment of transfer passages with a constricted opening cross-section.

In the embodiment shown in FIG. 18, the common channels 95 of the transfer passages 81 and 83 open with mouths 28" into the crankcase; the flow cross-section is reduced by walls 79. The walls 79 are arranged in slanted position relative to the separation plane 29 on the outwardly positioned side walls 90 positioned opposite the inwardly positioned side walls 89. The side walls 90 delimit the inlet-near transfer passages 83. The walls 78 and 79 may be inclined, as shown in FIGS. 17 and 18, relative to the separation plane 29. However, it can also be provided that the walls 78 of FIG. 17 are perpendicular to the separation plane 29 and extend up to the inwardly positioned side walls 89.

Figure 19:
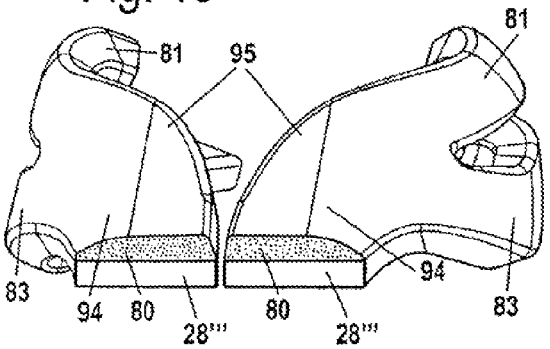
FIG. 19 is a perspective representation of yet another one embodiment of transfer passages with a constricted opening cross-section.

In the embodiment of FIG. 19, walls 80 are provided that reduce the flow cross-section of the mouths 26'". The walls 80 are arranged on the radially outwardly positioned outer walls 94 of the common channels 95 and can be arranged, like the walls 78 and 79, at a slant relative to the separation plane 29. Also, the walls 80 can extend perpendicularly to the separation plane 29 in upward direction until they intersect the outer walls 94.

Figure 20:
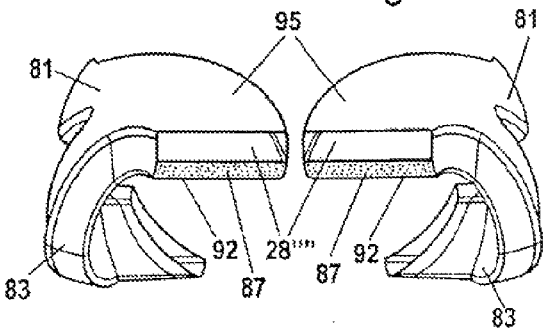
FIG. 20 is a perspective representation of yet another embodiment of transfer passages with a constricted opening cross-section.

In the embodiment shown in FIG. 20, walls 78 are provided on the inner walls 92 of the common channels 95 and reduce the flow cross-section of the mouths 28"". Also, the walls 92 can extend at a slant relative to the separation plane 29. It may also be provided to realize an adaptation of the flow cross-section of the transfer passages 81, 83 by other measures.

Figure 21:
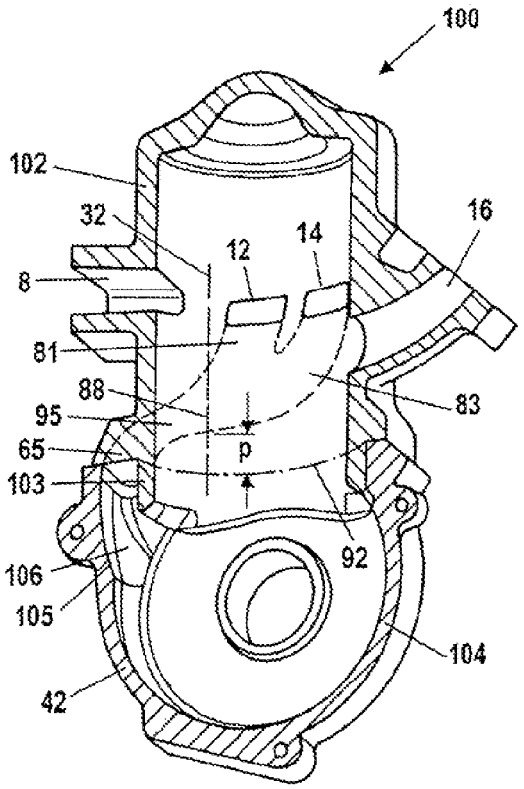
FIG. 21 is a perspective section illustration of an embodiment of a two-stroke engine, the section taken centrally through the outlet.
Figure 22:
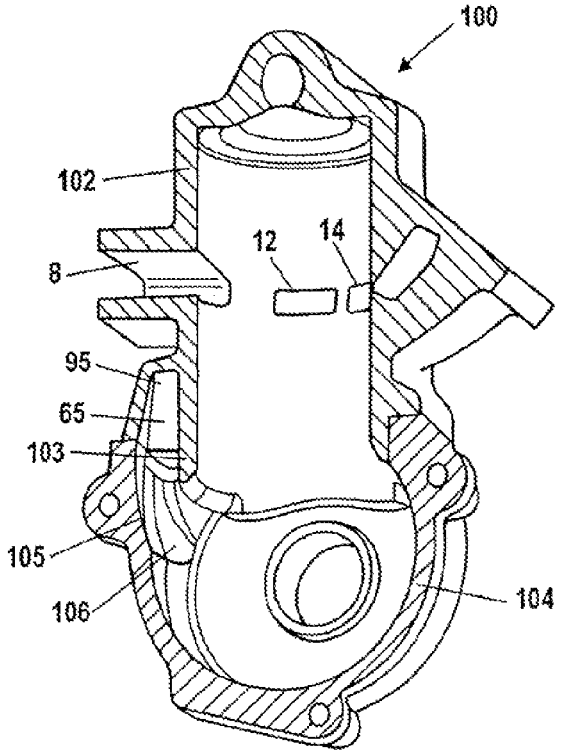
FIG. 22 shows the two-stroke engine of FIG. 21 in a section view where the section line is off-center relative to the outlet.

FIGS. 21 and 22 show a two-stroke engine 100 that corresponds essentially to a two-stroke engine that encompasses the cylinder 82. The two-stroke engine 100 has a cylinder 102 on which a circumferentially extending collar 103 is integrally formed that projects into the crankcase 104. The collar 103 projects past the separation plane 29 into the crankcase 104. The common channel 95 of the transfer passages 81 and 83 extends spirally within the cylinder 102 below the outlet 8. In this connection, the common channel 95 intersects at a junction 88 an imaginary third dividing plane 32 of the cylinder 102 that corresponds to the dividing plane 32 of FIG. 2. The junction 88 has a spacing p to the separation plane 29.

In the cylinder 102 both common passage segments 95 of the transfer passages 81 and 83 that are combined in each case on one cylinder side are separated by a wall 65. In the crankcase 104 the common channels 95 of both cylinder sides are joined. In this area the common channels 95 are separated by the collar 103 relative to the crankcase interior 42. In the crankcase 104 a depression 105 is formed in which the common passage segment 106 of the common channels 95 is extending. By delimiting the segment of the transfer passages 81 and 83 that extends in the crankcase 104 by means of a collar 103 of the cylinder 102 and a depression 105 of the crankcase 104 a simple configuration is provided. FIG. 22 shows a section plane that is rotated relative to the center plane of the cylinder 102. Here the junction of a channel 95 and the extension of the channel 95 along the wall 65 are shown.

FIG. 23 shows an embodiment of a cylinder 112 whose separation plane 119 is at the level of the axis of rotation 26 of the crankshaft 7. The transfer passages 91 and 93 are embodied completely in the cylinder 112 and do not pass into the crankcase, not shown. As shown in FIG. 23, inlet-near transfer passages 93 and outlet-near transfer passages 91 are provided that are joined before reaching a junction 88 into the second sector 35 of the cylinder 112 where the outlet 8 is provided. The junction 88 is arranged at a spacing q to the separation plane 119 so that the transfer passages 91 and 93 are extended into the area of the outlet 8 above the separation plane. Below the outlet 8 the common channels 95 of both cylinder halves are joined to a common passage segment 116. The transfer passages 91 and 93 open at a common opening 117 into the crankcase interior 42.

FIGS. 24 and 25 show a sand core 107 for producing the cylinder 112. The sand core 107 molds all transfer passages 91 and 93 and is embodied in a one-piece configuration. As shown in FIGS. 24 and 25, the sand core 107 has two molding segments 110 which mold the outlet-near transfer passages 91 as well as two molding segments 111 which mold the inlet-near transfer passages 93. Both molding segments 110 are connected with each other in the area forming the transfer ports by a connecting segment 108. A second connecting segment 109 is provided between the areas of the molding segments 111 which mold or form the transfer ports of the transfer passages 93. The sand core 107 has two molding segments 113 which mold the common channels 95 of the transfer passages 91 and 93. Both molding segments 113 are connected with each other by a molding segment 114 that molds or forms the common passage segment 116 of the common channels 95. In order to enable a simple manufacture of the sand core 107, the inner side walls 115 shown in FIG. 25 and the outer side walls 118 of the segments 111 of the sand core 107 extend parallel to each other. The side walls 115 and 118 are inclined by angle $\alpha$ relative to the longitudinal cylinder axis 24 of the finished cylinder which angle may amount to several degrees. The angle $\alpha$ ensures that the sand core 107 can be removed.

In order to enable removal of the sand core 107, it is also provided that the side walls 120 of the segments 110 and 111 facing each other are slanted away from each other. In this connection, the side walls 120 extend away from each other in such a way that, for drawing the mold for producing the sand core 107, no undercuts are formed in the side walls 120 in the direction of the longitudinal cylinder axis 24. Also, the connecting segments 108 and 109 are so arranged that for removal of the sand core 107 one mold half can be drawn in the direction of the longitudinal cylinder axis 24 upwardly and the second mold half in the direction of the longitudinal cylinder axis 24 downwardly, without undercuts being formed. Advantageously, drafts (ramps) are formed on surfaces of the sand core 107 that extend roughly parallel to the longitudinal cylinder axis 24.

Figure 27:
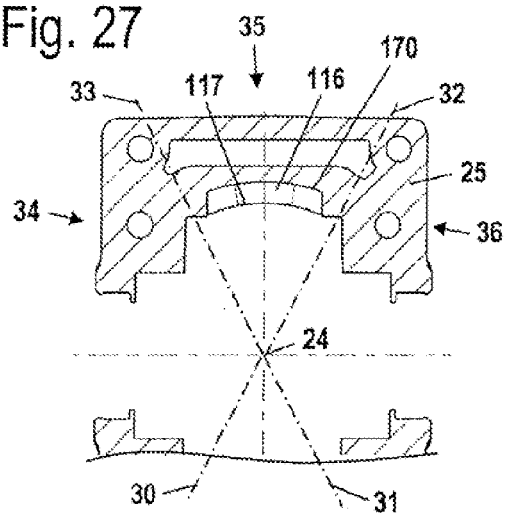
FIG. 27 is a section along the section line XXVII-XXVII of FIG. 26.
Figure 28:
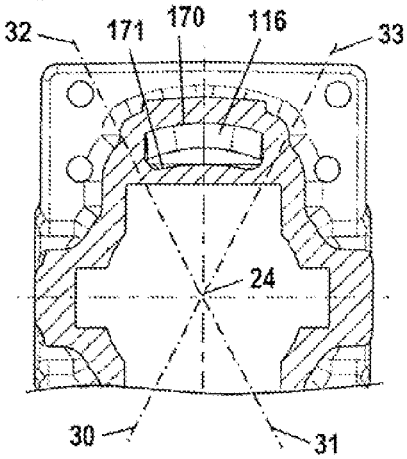
FIG. 28 is a section along the section line XXVIII-XXVIII of FIG. 26.

FIGS. 26 to 32 illustrate the course of the transfer passages 91 and 93 in several sections of the cylinder 112. FIG. 27 shows a section at the cylinder bottom 25. The common passage segment 116 of the common channels 95 opens in this area with an opening 117 into the crankcase interior. As shown in FIG. 27, the opening 117 is arranged in a second sector 35 in which also the outlet 8 (FIG. 32) is arranged. As shown in FIGS. 27 and 28, the outer wall 170 of the common passage segment 116 that extends relative to the longitudinal cylinder axis 24 radially outwardly is curved. The outer wall 170 is embodied as a segment of a circle whose center is located on the longitudinal cylinder axis 24. As shown in FIG. 28, the radially inwardly positioned inner wall 171 of the common passage segment 116 is also embodied as a segment of a circle that is concentric to the longitudinal cylinder axis 24.

Figure 29:
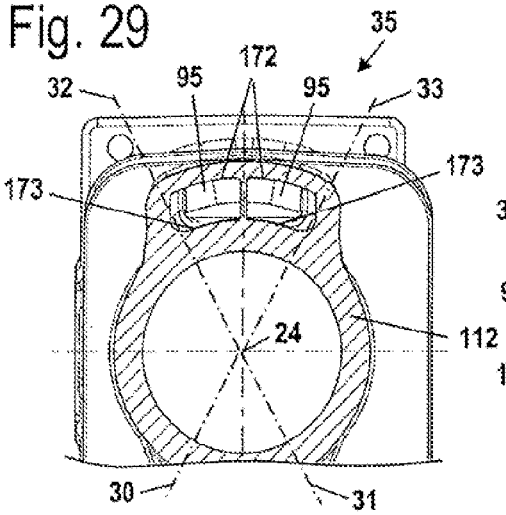
FIG. 29 is a section along the section line XXIX-XXIX of FIG. 26.

FIG. 29 shows a section of the cylinder 12 at a level where the common passage segment 116 is branching into the two common channels 95. Both channels 95 are separated at this level by a thin wall segment from each other. The radially outwardly positioned outer walls 172 of the common channels 95 are embodied as circular segments concentric to the longitudinal cylinder axis 24. The radially inwardly positioned inner walls 173 of the common channels 95 are circular segments concentric to the longitudinal cylinder axis 24. The distance of the inner walls 173 to the cylinder bore is therefore constant about the entire width of the common channels 95. In the section representation shown in FIG. 29, the common channels 95 are arranged approximately completely in the second sector 35.

Figure 30:
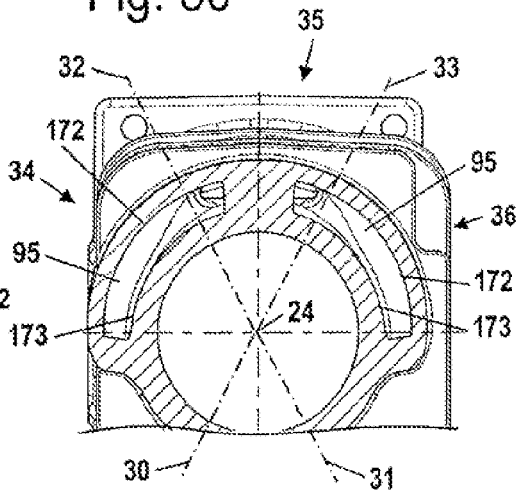
FIG. 30 is a section along the section line XXX-XXX of FIG. 26.

FIG. 30 shows a section of the cylinder 112 at a level where the common channels 95 pass from the second sector 35 into the first sector 34 or the third sector 36. Imaginary dividing planes 32 and 33 intersect the common channels 95 at this section plane. As shown in FIG. 30, the radially outwardly positioned outer walls 172 and the radially inwardly positioned inner walls 173 also extend at the section plane of FIG. 30 on circles concentric to the longitudinal cylinder axis 24. The distance of the inner walls 173 and the outer walls 172 relative to the cylinder bore is thus constant. Dead volumes between the common channels 95 and the cylinder bore can be avoided in this way. The transfer passages can extend closely around the cylinder bore.

Figure 31:
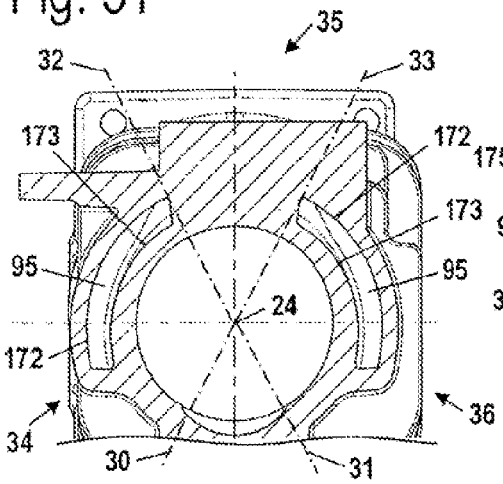
FIG. 31 is a section along the section line XXXI-XXXI of FIG. 26.

FIG. 31 shows a section representation of the cylinder 112 where the common channels 95 are arranged completely in the first sector 34 or in the third sector 36. At this section level the inner walls 173 and the outer walls 172 also extend on circles that are concentric to the longitudinal cylinder axis 24.

Figure 32:
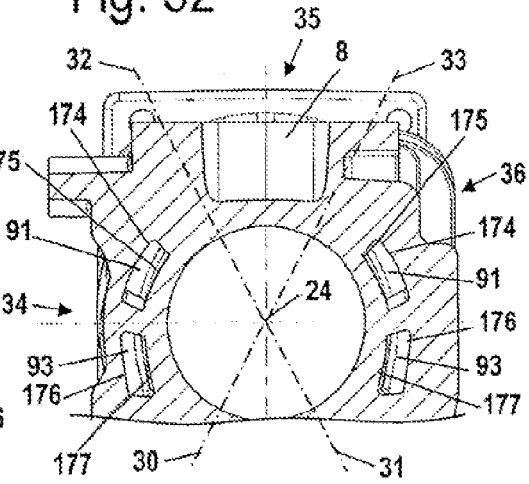
FIG. 32 is a section along the section line XXXII-XXXII of FIG. 26.

FIG. 32 shows a section below the transfer ports of the transfer passages 91 and 93. Between the section plane of FIG. 31 and the section plane of FIG. 32 the common channels 95 have branched into the transfer passages 91 and 93. The transfer passages 91 have each an outer wall 174 and an inner wall 175. The transfer passages 93 have each an inwardly positioned inner wall 177 and an outer wall 176 that is facing away from the cylinder bore. The inner walls 175 and the outer walls 174 of the outlet-near transfer passages 91 are embodied as circular segments of circles that are concentric to the longitudinal cylinder axis 24. The inner walls 177 and the outer walls 176 of the inlet-near transfer passages 93 deviate slightly from the circular segment shape in order to be able to realize the desired inflow angle of the transfer ports.

As shown in FIGS. 27 to 32, a compact configuration of the cylinder 112 results by the arrangement of the transfer passages in a spiral shape and concentric to the longitudinal cylinder axis 24. Material accumulations that can negatively affect the casting quality when producing the cylinder 112 in a casting process are avoided. At the same time a uniform flow guiding action is realized that causes the two-stroke engine to have low exhaust gas values.

Figure 33:
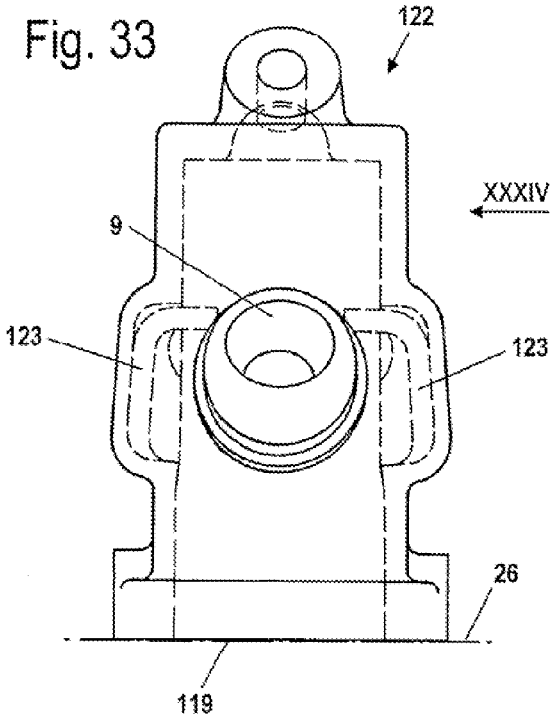
FIG. 33 is a schematic representation of a cylinder of a two-stroke engine in a side view.
Figure 34:
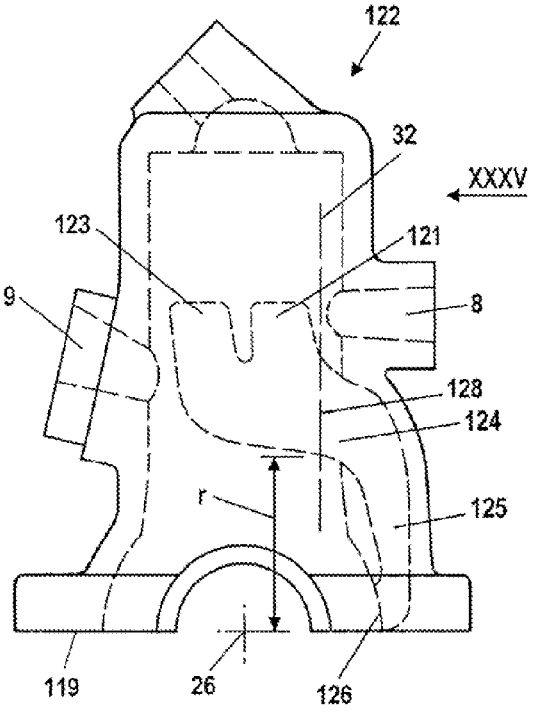
FIG. 34 is a side view in the direction of the arrow XXXIV of FIG. 33.
Figure 35:
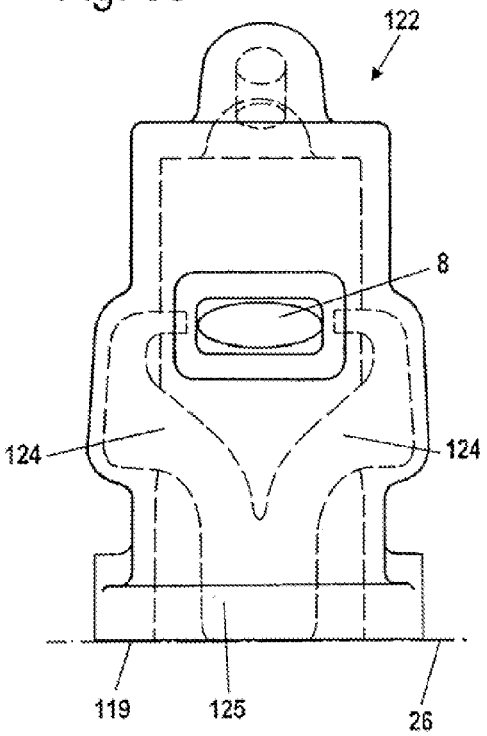
FIG. 35 is a side view in the direction of the arrow XXXV of FIG. 34.

Another embodiment of a cylinder 122 is shown in FIGS. 33 to 35. The cylinder 122 has also a separation plane 119 that extends at the level of the axis of rotation 26 of the crankshaft 7. The cylinder 122 has two outlet-near transfer passages 121 and two inlet-near transfer passages 123 that are embodied completely within the cylinder 122. The transfer passages 121 and 123 are joined to a common channel 124. The common channels 124 intersect the imaginary dividing plane 32 at a junction 128 that has a spacing r to the separation plane 119. Below the outlet 8 the two common channels 124 are joined in a common passage segment 125. All four transfer passages 121 and 123 open at a common opening 126 into the crankcase interior 42.

Figure 36:
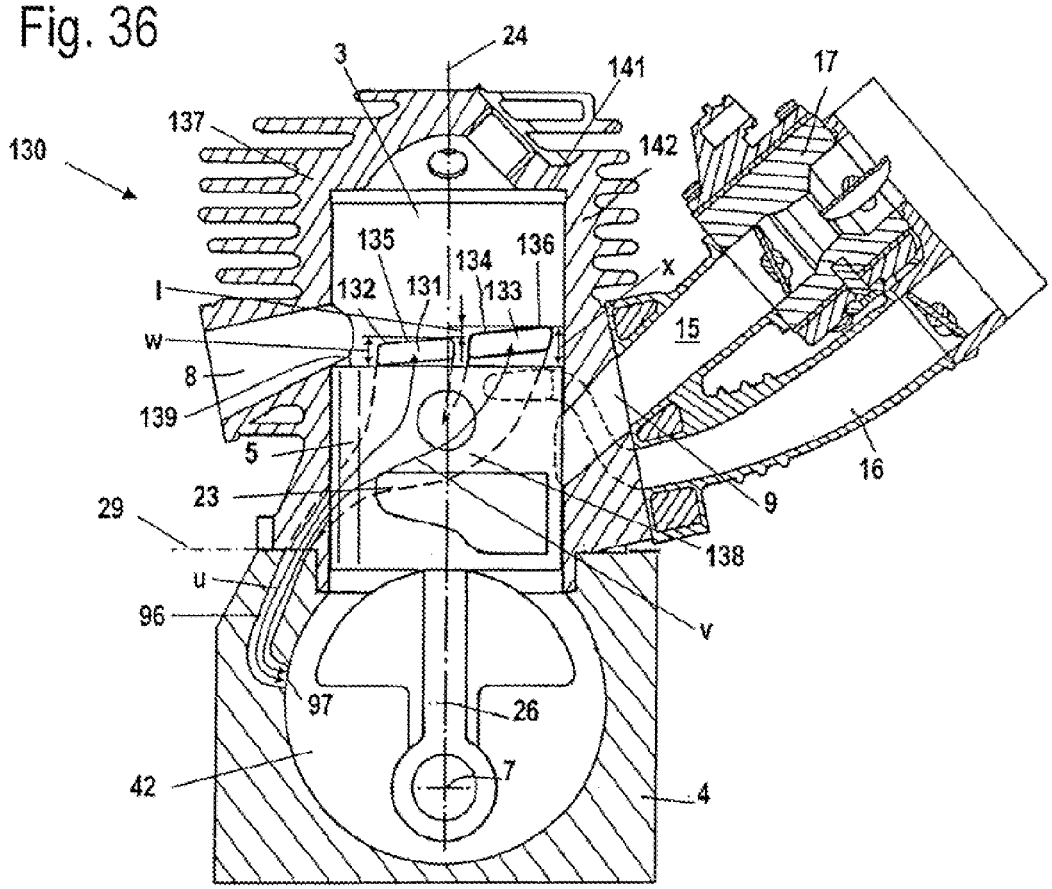
FIG. 36 is a schematic section illustration of another embodiment of a two-stroke engine.

In the embodiment of a two-stroke engine 130 shown in FIG. 36, two outlet-near transfer passages 131 that open with transfer ports 132 into the combustion chamber 3 and two inlet-near transfer passages 133 that open with transfer ports 134 into the combustion chamber 3 are provided. Two transfer passages 131 and 133 that are neighboring each other are joined in a cylinder 142 of the two-stroke engine 130 to form a common channel 138. The common channels 138 of the oppositely arranged transfer passages 131 and 133 are joined below the outlet 8 in a common passage segment 96 which opens with an opening 97 into the crankcase interior 42.

In this connection, the transfer passages 131 are shorter than the transfer passages 133. The outlet-near transfer passages 131 have a length u that is smaller than the length v of the inlet-near transfer passages 133. On account of the different lengths u, v of the transfer passages 131 and 133 turbulences may result in the area of the common channel 138. These turbulences result from the difference in time that the scavenging air needs for traveling in the transfer passages 131 or 133 from the supply passage 16 toward the common channel 138. To avoid this, it is provided that the transfer ports 132 and 134 have different control timing. The transfer port 132 has a control edge 135; this control edge 135 is the edge of the transfer port 132 that is opened first with the downward stroke of the piston 5. The transfer ports 134 have a corresponding control edge 136. Measured parallel to the longitudinal cylinder axis 24, the control edges 135 and 136 have a spacing l to each other.

The cylinder 142 has a combustion chamber cover 141 that delimits the cylinder 142 at the side facing away from the crankcase 4. The piston 5 has a piston bottom 139 delimiting the combustion chamber 3. The control edge 135 has a spacing w relative to the piston bottom 139 when the piston 5 is at bottom dead center (shown in FIG. 25) and the spacing w is smaller than a spacing x of the control edge 136 to the piston bottom 139 in this position of the piston 5. The transfer port 134 close to the inlet is thus opened first toward the combustion chamber 3.

When opening the transfer ports 132, 134 a pressure wave passes from the combustion chamber 3 into the transfer passages 131 and 133. Since the transfer port 134 opens before the transfer port 132 opens toward the combustion chamber 3, the pressure wave can already travel a certain distance in the inlet-near transfer passages 133 before the transfer passages 131 open toward the combustion chamber 3. In this way, it can be achieved that the pressure waves in both transfer passages reach approximately at the same time the area of the common channel 138. In this way, it is achieved that the scavenging air from the transfer passages 131 and 133 can stream approximately at the same time into the combustion chamber 3, although different control timings are provided for the transfer passages. However, by means of different control timing of the transfer passages 131 and 133 also a non-uniform flow can be realized, if so desired. The two-stroke engine 130 has a center plane 137 relative to which the cylinder 142 is embodied symmetrically.

Figure 37:
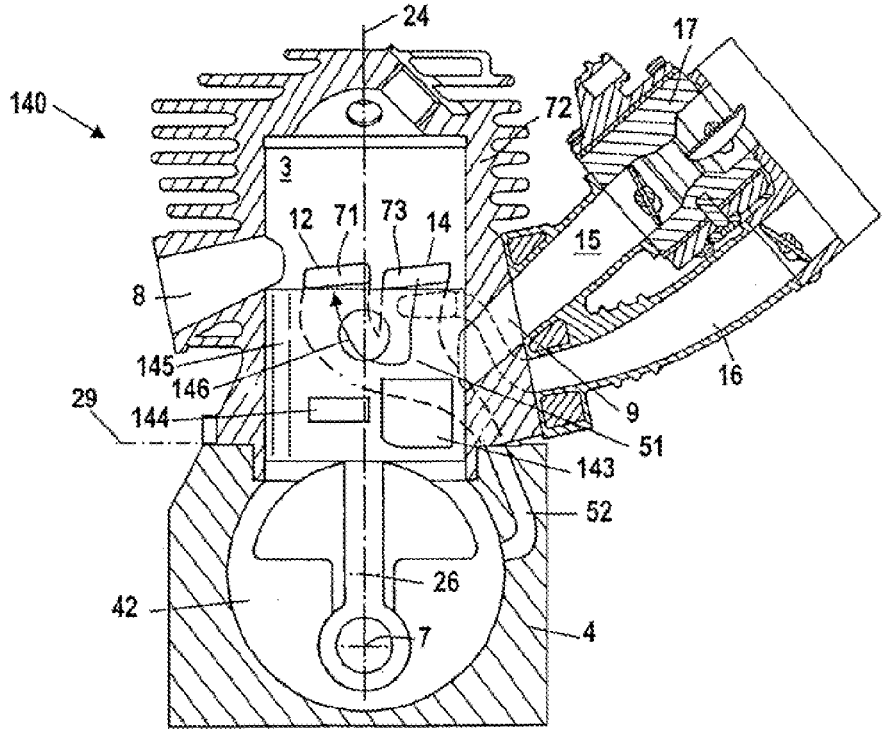
FIG. 37 is a schematic section illustration of another embodiment of a two-stroke engine.

In FIG. 37 an embodiment of a two-stroke engine 140 is shown whose design corresponds essentially to that of two-stroke engine 70 shown in FIG. 6. The two-stroke engine 140 has transfer passages 71 and 73 which extend about a part of their length in a cylinder 72. In the cylinder 72 a piston 145 is supported reciprocatingly and delimits the combustion chamber 3 in the cylinder 72. The piston 145 has a piston recess 143 that is closed toward the crankcase interior 42 and is arranged in the area of the transfer port 14 of the inlet-near transfer passage 73. In the area of the top dead center of the piston 145, scavenging air is supplied through the piston recess 143 from the supply passage 16 into the inlet-near transfer passage 73. The outlet-near transfer passage 71 is not connected in any position of the piston 145 with the piston recess 143. Thus, scavenging air supplied into the transfer port 14 flows in the direction of arrow 146 shown in FIG. 37 from the transfer passage 73 into the transfer passage 71.

In the piston 145 a piston port 144 is provided in the area of the outlet-near transfer port 12; in the area of top dead center of the piston 145 the piston port 144 connects the transfer port 71 with the crankcase interior 42. In this way, the transfer passage 71 can be scavenged completely with scavenging air from the transfer passage 73. Through the transfer passage 73 scavenging air is also supplied into the common channel 51. In operation of the two-stroke engine 140 scavenging air from the supply passage 16 is supplied through the transfer port 14 into the transfer passage 73 and in the direction of the arrow 146 through the common channel 51 into the transfer passage 71. The residual mixture from the last cycle that may still exist in the transfer passage 71 is forced through the transfer port 12 and the piston port 144 into the crankcase interior 42 so that the transfer passage 71 is scavenged completely.

Figure 38:
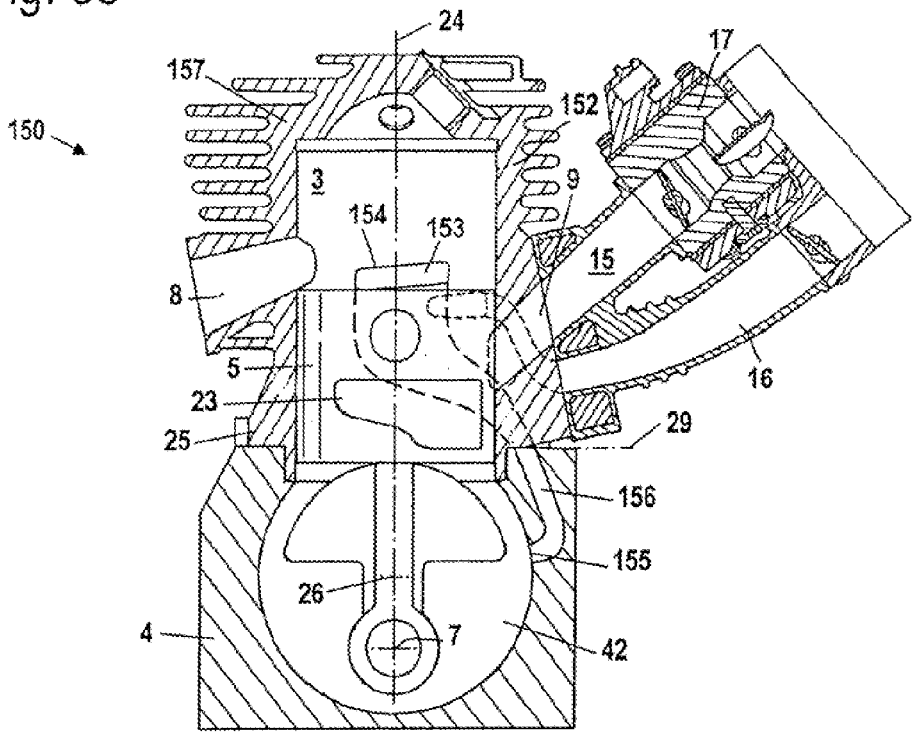
FIG. 38 is a schematic section illustration of another embodiment of a two-stroke engine.

In FIG. 38 a two-stroke engine 150 is shown which has a cylinder 152 in which two transfer passages 153 are formed on opposite sides of a center plane 157. The transfer passages 153 each open with a transfer port 154 into the combustion chamber 3 embodied in the cylinder 152. The transfer passages 153 extend into the area of the mixture inlet 9 and surround in a spiral shape the cylinder 152. In the area of the cylinder bottom 25 the transfer passages 153 pass into the crankcase 4. In this connection, the transfer passages 153 are joined in the separation plane 29 between cylinder 152 and crankcase 4. In the crankcase 4 both transfer passages 153 extend in a common passage segment 156 that opens with an opening 155 into the crankcase interior 42.

Figure 39:
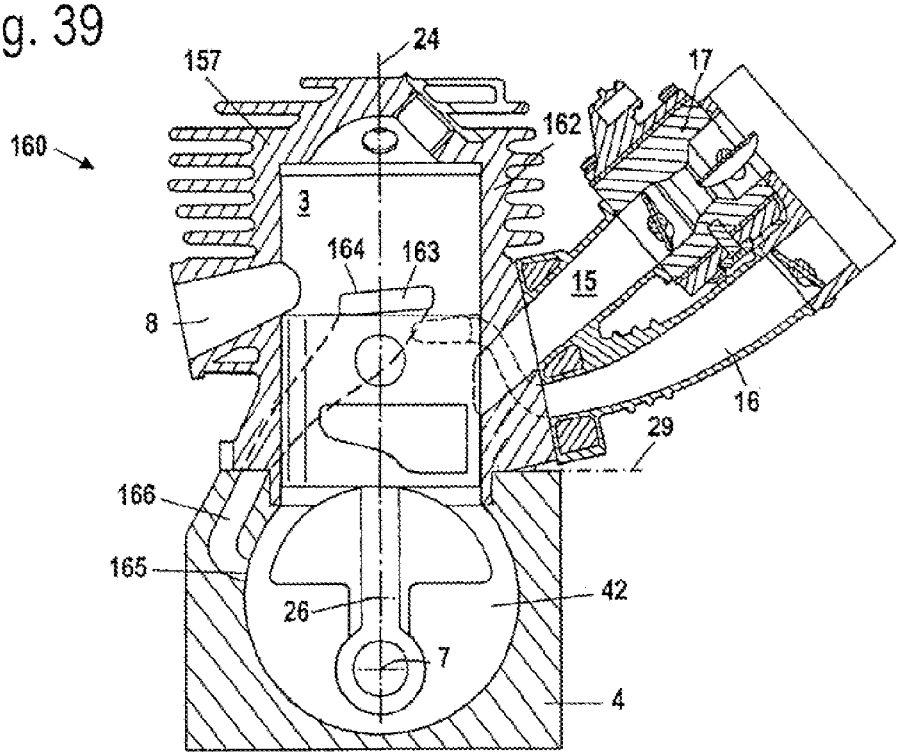
FIG. 39 is a schematic section illustration of another embodiment of a two-stroke engine.

In the embodiment of a two-stroke engine 160 shown in FIG. 39 two transfer passages 163 are embodied in a cylinder 162 and are arranged on opposite sides of a center plane 157; they each open with a transfer port 164 into the combustion chamber 3. The transfer passages 163 are joined below the outlet 8 at the separation plane 29. In the crankcase 4 both transfer passages 163 extend in a common passage segment 166 that opens with opening 165 into the crankcase interior 42. The two-stroke engines 150 and 160 illustrated in FIGS. 38 and 39 correspond otherwise to the other embodiments. The two-stroke engines 150 and 160 differ from the two-stroke engine 1 of FIG. 1 in that only one transfer passage is arranged on one side of the cylinder, respectively, and is guided below the outlet or the inlet.

Figure 40:
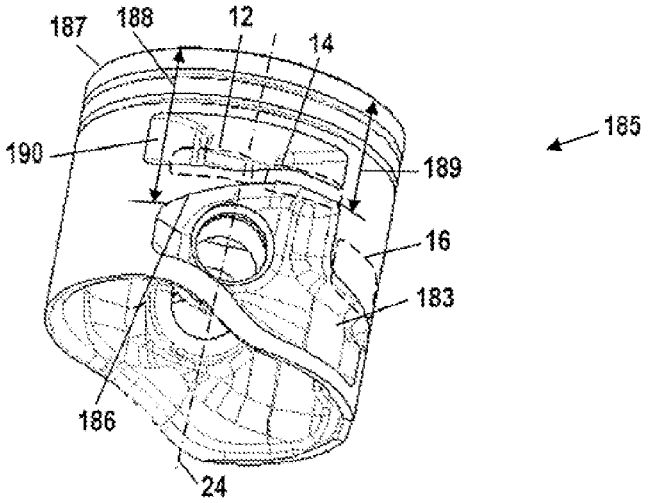
FIG. 40 is a perspective representation of an embodiment of a piston.

FIG. 40 shows a piston 185 that can be utilized in a two-stroke engine working with scavenging air, for example, in the illustrated two-stroke engines 1, 70, 100, 130, 150 or 160. In this connection, the two-stroke engine may have on each side of the cylinder a transfer passage or on each side of the cylinder two transfer passages, i.e., a total of four transfer passages.

The piston 185 has two symmetrically arranged piston recesses 183, of which in FIG. 40 one is visible. Between the piston recess 183 and the piston bottom 187 a cutout 190 is arranged for weight reduction. As shown in FIG. 40, the piston recess 183 has an upper edge 186 that is facing the piston bottom 187 and that does not extend straight but in circumferential direction of the piston has a section that is coiled or spirally shaped. In FIG. 40 transfer ports 12 and 14 are shown schematically as well as the opening of the supply passage 16. As shown in FIG. 40, the upper edge 186 in the area of the transfer port 12 close to the outlet has a spacing 188 to the piston bottom 187 and in the area of the transfer port 14 close to the inlet has a spacing 189 to the piston bottom 187. In this connection, the spacings 188, 189 are measured parallel to the longitudinal cylinder axis.

In the area of the outlet-near transfer port 12 the upper edge 186 extends in a side view of the piston 185, at a slant to the longitudinal cylinder axis. In the area of the inlet-near transfer port 14 only a short segment of the upper edge 186 is positioned at a slant. Essentially, the upper edge 186 extends in the area of the inlet-near transfer port 14 perpendicularly to the longitudinal cylinder axis 24 that in FIG. 40 is shown schematically. Since the distance 189 is smaller than the distance 188, the inlet-near transfer port 14 is connected first to the piston recess 183 and the supply passage 16.

In the position of the transfer ports 12 and 14 shown in FIG. 40, the outlet-near transfer port 12 is still closed relative to the piston recess 183. Only upon further upward stroke of the piston 185 the outlet-near transfer port 12 is also connected with the piston recess 183. The design of the piston recess 183 shown in FIG. 40 is in particular advantageous when the transfer passage that opens at the inlet-near transfer port 14 is longer than the transfer passage that opens at the outlet-near transfer port 12, i.e., in particular when all transfer passages are extending below the outlet of the two-stroke engine. By means of the inclined course of the upper edge 186, a steady instead of a sudden opening of the transfer port 12 into the piston recess 183 is provided.

Figure 41:
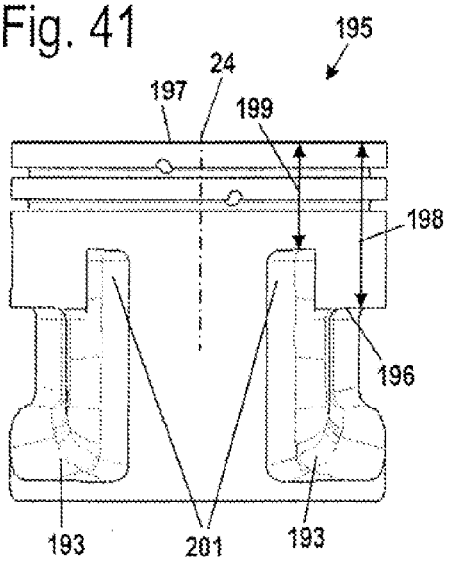
FIG. 41 is a side view of an embodiment of a piston.
Figure 42:
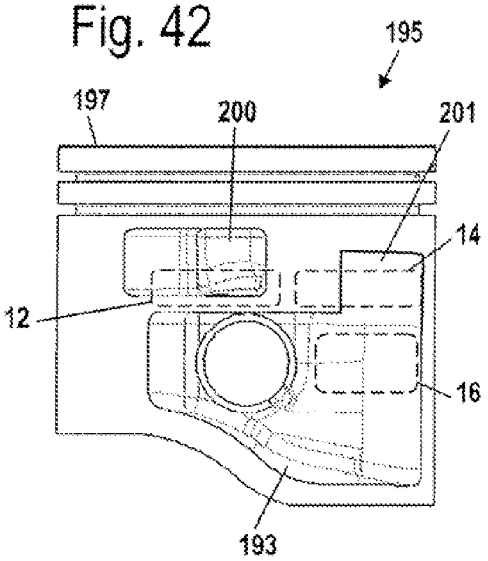
FIG. 42 is another side view of an embodiment of a piston.

The FIGS. 41 and 42 show an embodiment of a piston 195 which has two mirror-symmetrically embodied piston recesses 193. The piston recesses 193 have an upper edge 196 facing the piston bottom 197. The upper edge 196 extends essentially perpendicularly to the longitudinal cylinder axis 24. However, the piston recesses 193 have neighboring to the inlet-near transfer port 14 (FIG. 42) a segment 201 in which the upper edge 196 is arranged so as to be displaced in the direction of the piston bottom 197. The distance 199 of the upper edge 196 in the area of the segment 201 is significantly smaller than the distance 198 of the upper edge 196 in the area of the outlet-near transfer ports 12. The segment 201 extends in circumferential direction advantageously about a portion of the transfer port 14 and not about the entire transfer port 14. Through the segment 201 the transfer port 14 is connected already with the supply passage 16 in the position of the piston 195 schematically shown in FIG. 42 while the transfer port 12 is still sealed relative to the piston recess 193. Between the piston recess 193 and the piston bottom 197 a cutout 200 is provided for weight reduction. The design of a piston recess 193 shown in FIGS. 41 and 42 is in particular advantageous in two-stroke engines where the transfer passages that open at the transfer ports 14 are longer than the transfer passages that open in the transfer ports 12, for example, in case of transfer passages extending below the outlet.

The shown shape of the transfer passages is advantageous for two-stroke engines which work with scavenging air as well as for two-stroke engines without scavenging air. For two-stroke engines with scavenging air as well as for two-stroke engines without scavenging air low exhaust gas values are obtained. The good flow properties and the low exhaust gas values also result from the arrangement of the transfer passages concentric to the longitudinal cylinder axis 24, as shown in particular in FIG. 27 to 32. This embodiment of the inner walls and the outer walls of the transfer passages as circular segments concentric to the longitudinal cylinder axis 24 is advantageous for all shown cylinders.

The specification incorporates by reference the entire disclosure of German priority document 10 2009 059 143.5 having a filing date of Dec. 19, 2009.

While specific embodiments of the invention have been shown and described in detail to illustrate the inventive principles, it will be understood that the invention may be embodied otherwise without departing from such principles.

What is claimed is:

1. A two-stroke engine comprising:

a cylinder with a combustion chamber disposed therein;

a piston reciprocatingly supported in the cylinder and delimiting the combustion chamber;

a crankshaft rotatably supported in a crankcase and driven in rotation by the piston;

at least two transfer passages having an opening that opens into an interior of the crankcase, the at least two transfer passages connecting the crankcase in at least one position of the piston with the combustion chamber, wherein the transfer passages each open by a piston-controlled transfer port provided in the cylinder into the combustion chamber;

wherein the at least two transfer passages each have a passage length beginning at the transfer port and ending at the opening;

an inlet that opens into the crankcase;

an outlet provided at the combustion chamber;

wherein the two-stroke engine is dividable into four sectors: a first sector, a second sector, a third sector, and a fourth sector that extend parallel to a longitudinal cylinder axis, respectively;

wherein the transfer port of a first one of the transfer passages is arranged in the first sector, wherein the outlet is arranged in the second sector adjoining the first sector, wherein the transfer port of a second one of the transfer passages is provided in the third sector adjoining the second sector, and wherein the inlet into the crankcase is arranged in the fourth sector that is located between the first sector and the third sector;

wherein, within the cylinder, the first and second transfer passages each have a segment of the passage length, said segment of the passage length arranged at a spacing to a separation plane between the cylinder and the crankcase, wherein said segments of the passage length pass together into one of the second and fourth sectors adjoining the first and third sectors;

wherein the first and second transfer passages have a common passage segment in which the first and second transfer passages extend together, wherein the common passage segment is a segment of the passage length of the first and second transfer passages located at an end of the passage length facing the crankcase; and wherein the common passage segment ends at the opening of the first and second transfer passages and opens with the opening of the first and second transfer passages into the crankcase, wherein the opening of the first and second transfer passages is positioned in the second sector below the outlet or is positioned in the fourth sector below the inlet.

2. The two-stroke engine according to claim 1, wherein the first and second transfer passages are joined at the separation plane between the cylinder and the crankcase.

3. The two-stroke engine according to claim 1, wherein the first and second transfer passage are joined within the cylinder.

4. The two-stroke engine according to claim 1, wherein the first and second transfer passages have radially outwardly positioned outer walls and radially inwardly positioned inner walls, wherein the inner and outer walls are positioned at least over a section of the length of the first and second transfer passages as circular segments that extend approximately concentric to the longitudinal cylinder axis.

5. The two-stroke engine according to claim 1, wherein the crankcase is comprised of two half shells joined at a joining plane extending parallel to the longitudinal cylinder axis, wherein the first and second transfer passages extend in the crankcase within the joining plane.

6. The two-stroke engine according to claim 1, wherein the crankcase has a depression and wherein the cylinder has a collar that extends past the separation plane between the crankcase and the cylinder into the crankcase, wherein the collar and the depression together form the first and second transfer passages.

7. The two-stroke engine according to claim 1, wherein the cylinder has four of the transfer ports, wherein two of the four transfer ports are arranged in the first sector and two of the four transfer ports are arranged in the third sector.

8. The two-stroke engine according to claim 7, wherein two of the four transfer passages are joined with a segment of their respective passage length that is located in the second sector, respectively, and two of the four transfer passages are joined with a segment of their respective passage length that is located in the fourth sector, respectively.

9. The two-stroke engine according to claim 7, wherein the four transport passages connected to the four transfer ports are all joined in a segment of their respective passage length within one of the four sectors.

10. The two-stroke engine according to claim 7, wherein:

the transfer port of a first one of the transfer passages and the transfer port of a second one of the transfer passages open together in the first sector or in the third sector into the combustion chamber, wherein the transfer port of the first transfer passage is arranged near the inlet and the transfer port of the second transfer passage is arranged near the outlet;

wherein the passage length of the first transfer passage with the transfer port positioned near the inlet is longer than the passage length of the second transfer passage with the transfer port positioned near the outlet;

wherein the piston has a piston bottom delimiting the combustion chamber;

wherein the transfer port of the first transfer passage has a first control edge where upon downward stroke of the piston the transfer port of the first passage is opened first and wherein the transfer port of the second transfer passage has a second control edge where upon downward stroke of the piston the transfer port of the second transfer passage opens first;

wherein the first control edge has a first spacing to the piston bottom at bottom dead center of the piston and the second control edge has a second spacing to the piston bottom at bottom dead center of the piston, wherein second spacing is smaller than the first spacing;

wherein the transfer port of the first transfer passage that is longer opens upon downward stroke of the piston before the transfer port of the second transfer passage that is shorter.

11. The two-stroke engine according to claim 7, wherein two of the transfer passages connected to the two transfer ports arranged together in the first sector or the third sector are joined in a common channel in a segment of the respective passage length, wherein joining of the two transfer passages to form the common channel begins at a spacing from the separation plane between the cylinder and the crankcase, and wherein the two transfer passages are joined in the first sector or the third sector where the two transfer ports to which the two transfer passages are connected are located.

12. The two-stroke engine according to claim 7, comprising a supply passage for scavenging air that opens at the cylinder, wherein the piston has a piston recess that connects the supply passage to one of the transfer ports near the inlet, wherein one of the transfer ports near the outlet is connected through the piston to the crankcase interior.

13. The two-stroke engine according to claim 7, comprising a supply passage for scavenging air that opens at the cylinder, wherein the piston has a piston recess that connects the supply passage with the transfer ports, wherein a first one of the transfer ports in at least one position of the piston is completely sealed and a second one of the transfer ports neighboring the first one is already connected through the piston recess with the supply passage.

14. The two-stroke engine according to claim 7, comprising a supply passage for scavenging air that opens at the cylinder, wherein the piston has a piston recess that connects the supply passage with the transfer ports, wherein the piston recess has an upper edge having a spacing to a piston bottom of the piston, wherein the spacing changes in a circumferential direction of the piston.

15. The two-stroke engine according to claim 1, wherein at least one of the transfer passages extends within the cylinder such that a mouth of the at least one transfer passage has a wide side and a narrow side measured perpendicularly to the wide side, wherein a length of the wide side decreases in cross-sections perpendicular to a flow direction to the transfer port of the at least one transfer passage, wherein a length of the narrow side increases in cross-sections perpendicular to the flow direction to the transfer port of the at least one transfer passage, wherein in a cross-section, taken perpendicular to the flow direction adjacent to the transfer port, the length of the wide side is smaller than the length of the narrow side, and wherein a product of the length of the wide side and the length of the narrow side for each one of the cross-sections of the transfer passage taken perpendicular to the flow direction is essentially the same.

16. A two-stroke engine comprising:

a cylinder with a combustion chamber disposed therein;

a piston reciprocatingly supported in the cylinder and delimiting the combustion chamber;

a crankshaft rotatably supported in a crankcase and driven in rotation by the piston;

at least four transfer passages connecting the crankcase in at least one position of the piston with the combustion chamber, wherein the transfer passages each open by a piston-controlled transfer port provided in the cylinder into the combustion chamber;

an inlet that opens into the crankcase;

an outlet provided at the combustion chamber;

wherein the two-stroke engine is dividable into four sectors: a first sector, a second sector, a third sector, and a fourth sector that extend parallel to a longitudinal cylinder axis, respectively;

wherein the transfer port of a first one of the transfer passage and the transfer port of a second one of the transfer passages are arranged in the first sector, wherein the outlet is arranged in the second sector adjoining the first sector, wherein the transfer port of a third one of the transfer passages and the transfer port of a fourth one of the transfer passages are provided in the third sector adjoining the second sector, and wherein the inlet into the crankcase is arranged in the fourth sector that is located between the first sector and the third sector;

wherein the transfer passages extend within the cylinder in a spiral shape about the combustion chamber;

wherein, within the cylinder, the first and second transfer passages, at a spacing to a separation plane between the cylinder and the crankcase pass together into the second sector;

wherein the first, second, third, and fourth transfer passages open with a common opening into the crankcase in the second sector.

17. The two-stroke engine according to claim 16, wherein the first, second, third, and fourth transfer passages have a passage length beginning at the transfer port and ending at an opening into the crankcase, respectively, wherein the first, second, third, and fourth transfer passages have a common passage segment in which the first, second, third and fourth transfer passages extend together, wherein the common passage segment is a segment of the respective passage length at an end of the first, second, third, and fourth transfer passages that is facing the crankcase, and wherein the common passage section opens with the openings of the first, second, third and fourth transfer passages into the crankcase.

18. The two-stroke engine according to claim 16, wherein the first, second, third, and fourth transfer passages are joined within the common passage segment.

* * * * *